US011840391B1

(12) United States Patent
Kooistra et al.

(10) Patent No.: US 11,840,391 B1
(45) Date of Patent: Dec. 12, 2023

(54) MULTIPURPOSE REUSABLE CONTAINER SYSTEM

(71) Applicants: Mika Kooistra, Emo (CA); Cody Alexander Minderhoud, Mission (CA); Jeffrey Thomas Ploegstra, Sioux Center, IA (US); Kevin Jay Timmer, Sioux Center, IA (US)

(72) Inventors: Mika Kooistra, Emo (CA); Cody Alexander Minderhoud, Mission (CA); Jeffrey Thomas Ploegstra, Sioux Center, IA (US); Kevin Jay Timmer, Sioux Center, IA (US)

( * ) Notice: Subject to any disclaimer, the term of this patent is extended or adjusted under 35 U.S.C. 154(b) by 98 days.

(21) Appl. No.: 17/539,605

(22) Filed: Dec. 1, 2021

(51) Int. Cl.

| | |
|---|---|
| ***B65D 81/36*** | (2006.01) |
| ***B65D 21/02*** | (2006.01) |
| ***B65D 1/02*** | (2006.01) |
| ***E04B 2/08*** | (2006.01) |
| ***E04B 2/12*** | (2006.01) |
| ***B65D 41/32*** | (2006.01) |
| *E04B 2/02* | (2006.01) |

(52) U.S. Cl.
CPC ..... *B65D 81/361* (2013.01); *B65D 1/0223* (2013.01); *B65D 21/0204* (2013.01); *B65D 41/32* (2013.01); *E04B 2/08* (2013.01); *E04B 2/12* (2013.01); *E04B 2002/0223* (2013.01); *E04B 2002/0256* (2013.01)

(58) Field of Classification Search
CPC .. B65D 1/0223; B65D 21/0204; B65D 41/32; B65D 81/361; E04B 2/08; E04B 2/12; E04B 2002/0223; E04B 2002/0256
See application file for complete search history.

(56) References Cited

U.S. PATENT DOCUMENTS 4,035,947 A * 7/1977 Burge ..... A63H 33/082 446/127
4,308,955 A * 1/1982 Schieser ..... B65D 21/0202 220/675
4,656,840 A * 4/1987 Loofbourrow ..... F25D 3/08 428/33

(Continued)

FOREIGN PATENT DOCUMENTS

DE 19643439 C1 * 7/1998 ..... B65D 21/0202
DE 202018103102 U1 * 7/2018

(Continued)

*Primary Examiner* — James M Ference
(74) *Attorney, Agent, or Firm* — Jeffrey A. Proehl; Woods, Fuller, Shultz & Smith, PC

(57) ABSTRACT

A system may include at least one multipurpose container with a bottle portion and a cap portion, and the bottle portion may include a bottle wall about the interior and forming an outer surface. The outer surface may have primary faces configured to permit vertical stacking of the container on another container in a stack of containers, and secondary faces. Alignment features may facilitate alignment of the bottle portions in a stack of containers, and at least a pair of the alignment features may be located on the primary faces. The alignment features may include at least one aligning lug located on and protruding from the first primary face and at least one aligning recess located on and depressed into the second primary face to removably receive the at least one aligning lug of a said container in the stack of containers.

18 Claims, 19 Drawing Sheets

(56) References Cited

U.S. PATENT DOCUMENTS 4,708,253 A * 11/1987 Mednis ..... B65D 21/0231 446/124
5,271,515 A * 12/1993 Berkheimer ..... B65D 21/023 220/4.27
5,310,071 A * 5/1994 Rivlin ..... B65D 81/361 206/509
5,779,051 A * 7/1998 Boutin ..... B65D 21/0231 206/511
5,782,358 A * 7/1998 Walker ..... B65D 23/12 206/509
5,832,687 A * 11/1998 Willemsen ..... E04B 2/08 52/603
5,853,314 A * 12/1998 Bora ..... A63H 33/086 446/124
5,915,582 A * 6/1999 Wawzonek ..... B65D 81/361 220/DIG. 13
D412,662 S * 8/1999 Giskeødegaard ..... D9/636
6,276,549 B1 * 8/2001 Fasci ..... B65D 21/0202 220/23.6
D447,944 S * 9/2001 Justice ..... D9/745
6,506,091 B1 * 1/2003 Garpow ..... E04B 2/08 446/124
7,175,498 B2 * 2/2007 Garpow ..... B65D 81/361 446/124
7,516,860 B1 * 4/2009 Fenton ..... B65D 21/0204 215/10
7,644,828 B1 * 1/2010 Klein ..... A63H 33/067 220/23.6
8,662,328 B2 * 3/2014 Boisvert ..... B65D 21/0231 220/759
9,278,781 B1 * 3/2016 Boldis ..... B65D 21/0231
9,480,932 B2 * 11/2016 Weiss ..... B65D 21/023
9,802,138 B2 * 10/2017 Weiss ..... A63H 33/062
D809,935 S * 2/2018 Weiss ..... D9/566
10,507,953 B1 * 12/2019 Worsham ..... B65D 1/0207
2004/0116037 A1 * 6/2004 Garpow ..... A63H 33/08 446/74
2009/0090647 A1 * 4/2009 Panchal ..... B65D 21/0231 206/509
2011/0204051 A1 * 8/2011 Pawl ..... B65D 21/0231 29/428
2013/0213846 A1 * 8/2013 Hendrickson ..... B65D 21/0216 206/509
2013/0213927 A1 * 8/2013 Hendrickson ..... E04H 1/005 215/383
2017/0021995 A1 * 1/2017 Corbett ..... B65D 41/04
2017/0043272 A1 * 2/2017 Weiss ..... A63H 33/062
2018/0258640 A1 * 9/2018 Herrin ..... E04B 2/18
2020/0087050 A1 * 3/2020 Seichei ..... B65D 21/0204

FOREIGN PATENT DOCUMENTS

FR 3008075 A1 * 1/2015 ..... A63H 33/082
WO 2007129910 11/2007
WO WO-2011020128 A1 * 2/2011 ..... B65D 21/0202
WO WO-2012038928 A1 * 3/2012 ..... A01G 25/14

* cited by examiner

MULTIPURPOSE REUSABLE CONTAINER SYSTEM

BACKGROUND

Field

The present disclosure relates to containers and more particularly pertains to a new multipurpose reusable container system for facilitating multiple purposes and multiple usages of a container.

SUMMARY

In one aspect, the present disclosure relates to a system which may comprise at least one multipurpose container configured to contain a flowable substance and form a structural element. The container may comprise a bottle portion and a cap portion, and define an interior and have an opening into the interior for receiving the flowable substance into the interior and dispensing the flowable substance from the interior. The bottle portion may include a bottle wall extending about the interior and may form an outer surface. The outer surface may have primary faces oriented substantially opposite of each other on the bottle portion and being configured to permit vertical stacking of the container on another said container in a vertical direction in a stack formed of said containers, and the primary faces may include a first primary face and a second primary face. The outer surface may also have secondary faces oriented substantially opposite with respect to each other on the bottle portion and being configured to permit horizontal adjacency of the container with another said container in a horizontal direction in the stack of containers, and the secondary faces may include a first secondary face and a second secondary face. The outer surface may further have alignment features configured to facilitate alignment of the bottle portions when two or more containers are arranged in the stack of containers. At least a pair of the alignment features may be located on the primary faces, and the alignment features may include at least one aligning lug located on and protruding from the first primary face and at least one aligning recess located on and depressed into the second primary face to removably receive the at least one aligning lug of a said container in the stack of containers.

In another aspect, the present disclosure relates to a system which may comprise a plurality of multipurpose containers each configured to contain a flowable substance and form a structural element positionable in a stack of the containers to form a wall. Each container may comprise a bottle portion and a cap portion, and the bottle portion of each container may define an interior and have an opening into the interior for receiving the flowable substance into the interior and dispensing the flowable substance from the interior. The bottle portion of each container may include a bottle wall extending about the interior and forming an outer surface. The outer surface of each container may have primary faces being oriented substantially opposite of each other on the bottle portion and being configured to permit vertical stacking of one said container of the plurality of containers on another said container of the plurality of containers in a vertical direction to form the stack of containers. The primary faces may include a first primary face and a second primary face. The outer surface of each container may also have secondary faces being oriented substantially opposite with respect to each other on the bottle portion and being configured to permit horizontal adjacency of said one container to said another container in a horizontal direction in the stack of containers. The secondary faces may include a first secondary face and a second secondary face. The outer surface of each container may further have alignment features configured to facilitate alignment of the bottle portions of two or more containers when the plurality of containers are arranged in the stack of containers, and at least a pair of the alignment features may be located on the primary faces. The alignment features may include at least one aligning lug located on and protruding from the first primary face, and at least one aligning recess located on and depressed into the second primary face to removably receive the at least one aligning lug of a said container in the stack of containers.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
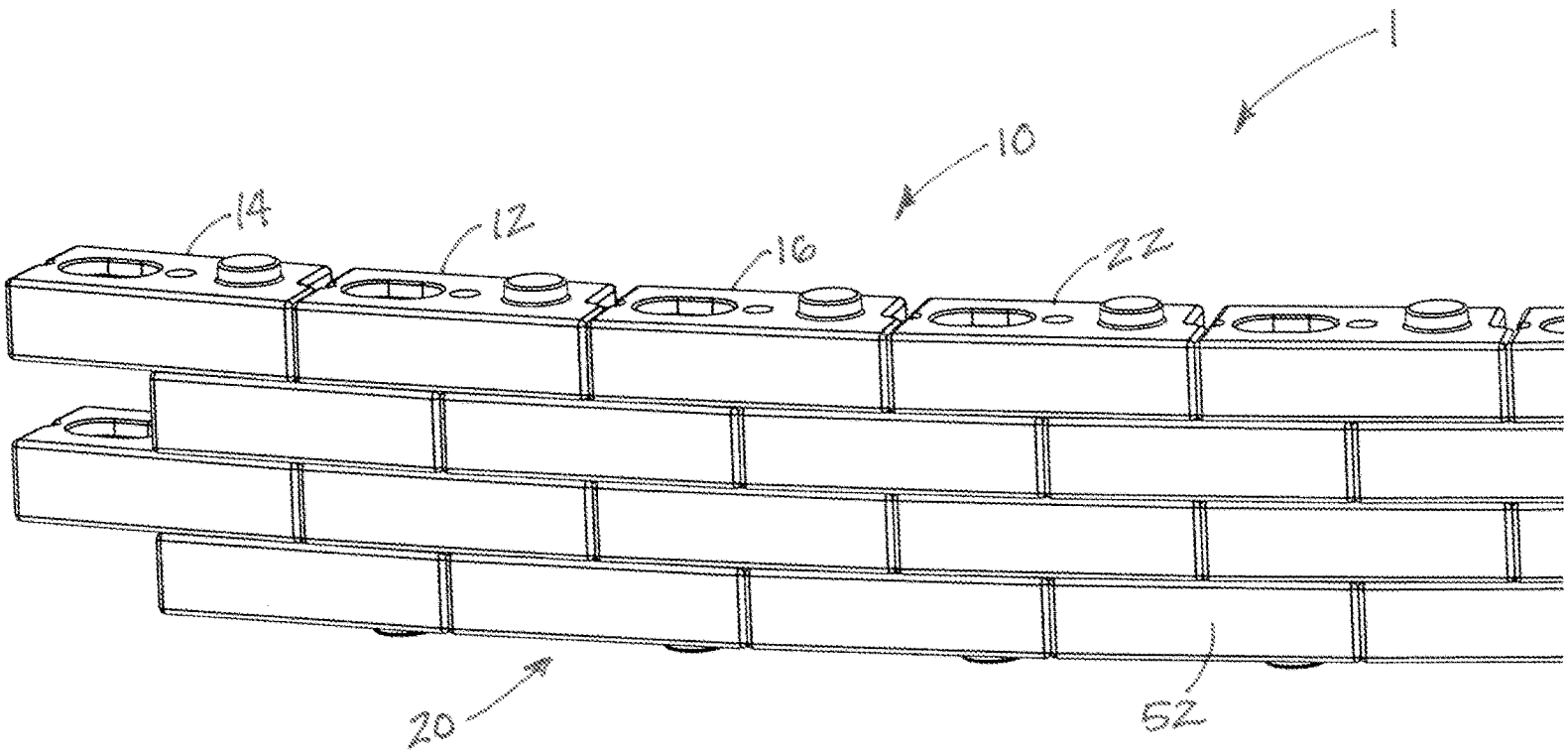
FIG. 1 is a schematic perspective view of a new multipurpose reusable container system showing a stack of containers each having an illustrative configuration, according to the present disclosure.
Figure 2:
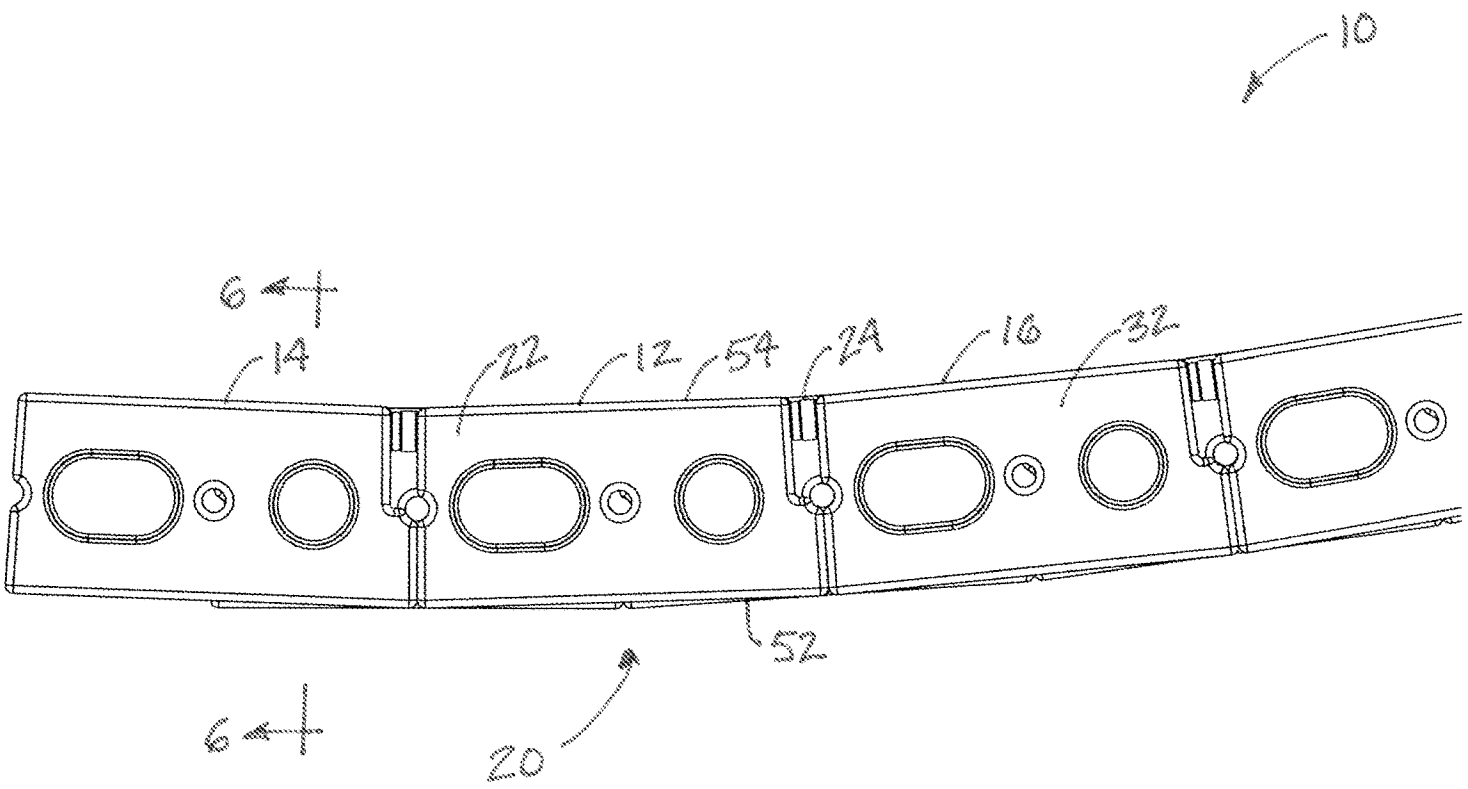
FIG. 2 is a schematic top view of the stack of containers having the configuration shown in FIG. 1, according to an illustrative embodiment.
Figure 3:
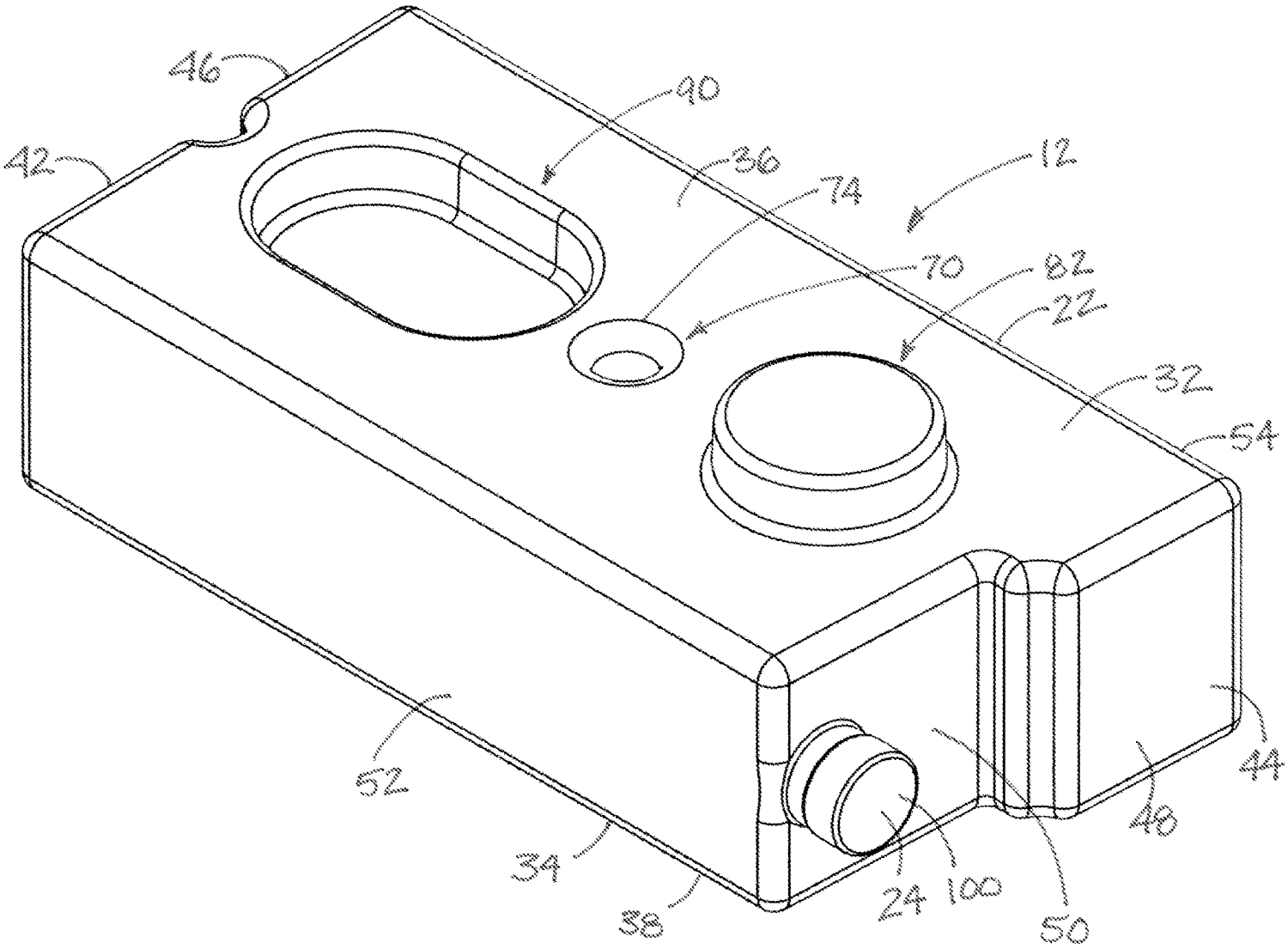
FIG. 3 is a schematic perspective view of a container having the illustrative configuration shown in FIG. 1, according to an illustrative embodiment.
Figure 4:
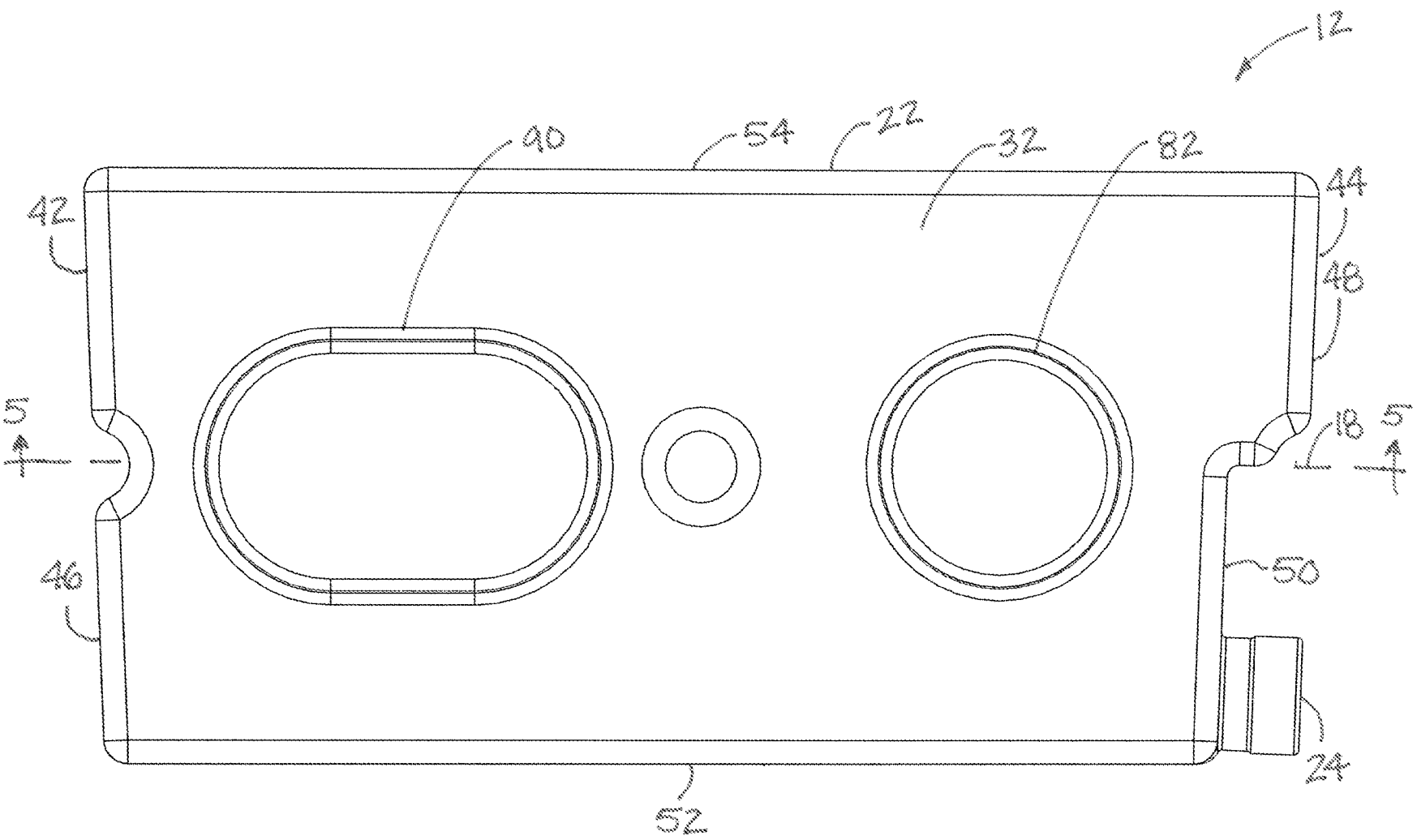
FIG. 4 is a schematic top view of a container having the illustrative configuration shown in FIG. 1, according to an illustrative embodiment.
Figure 5:
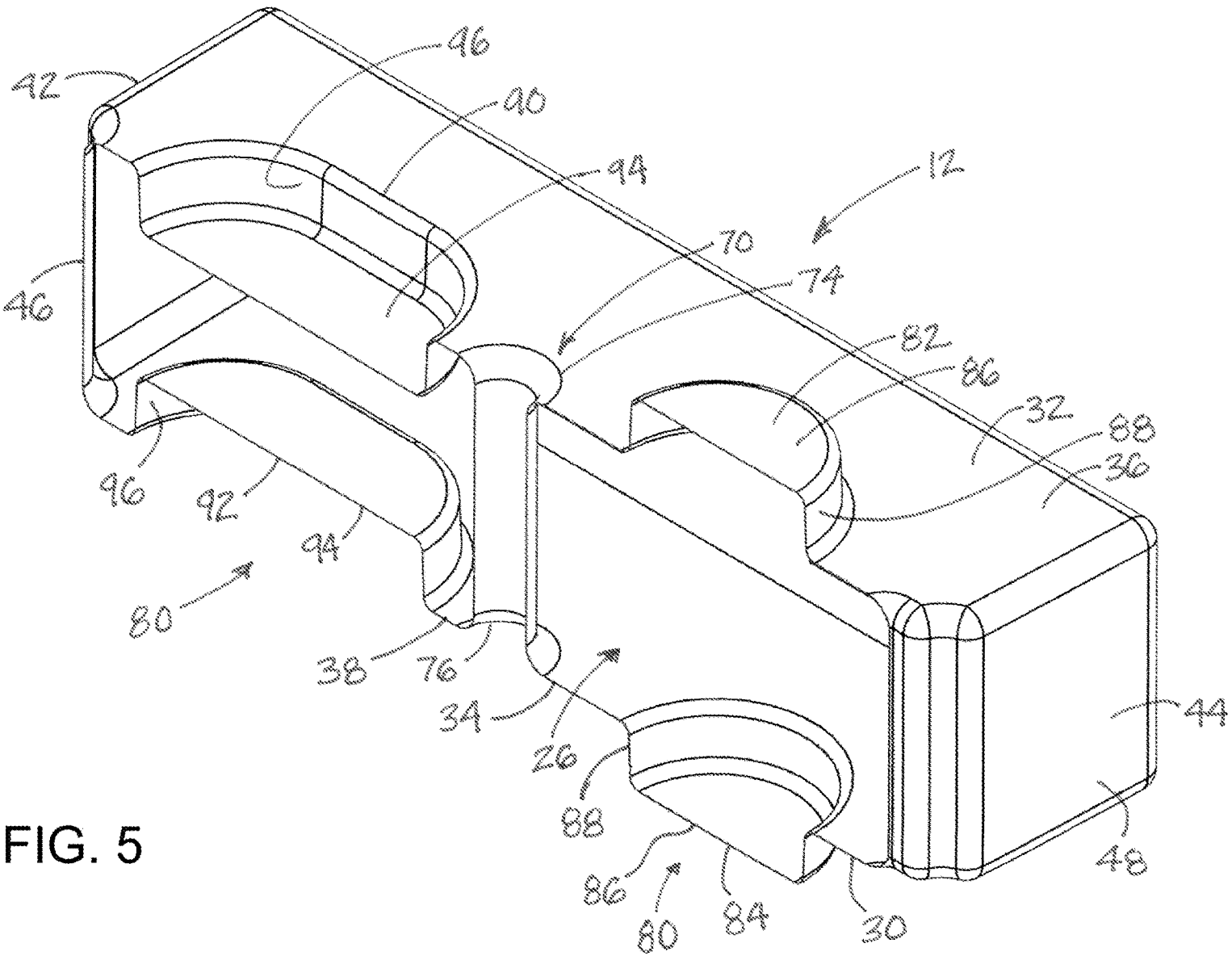
FIG. 5 is a schematic sectional view of a container having the illustrative configuration shown in FIG. 1, taken along line 5-5 in FIG. 4, according to an illustrative embodiment.
Figure 6:
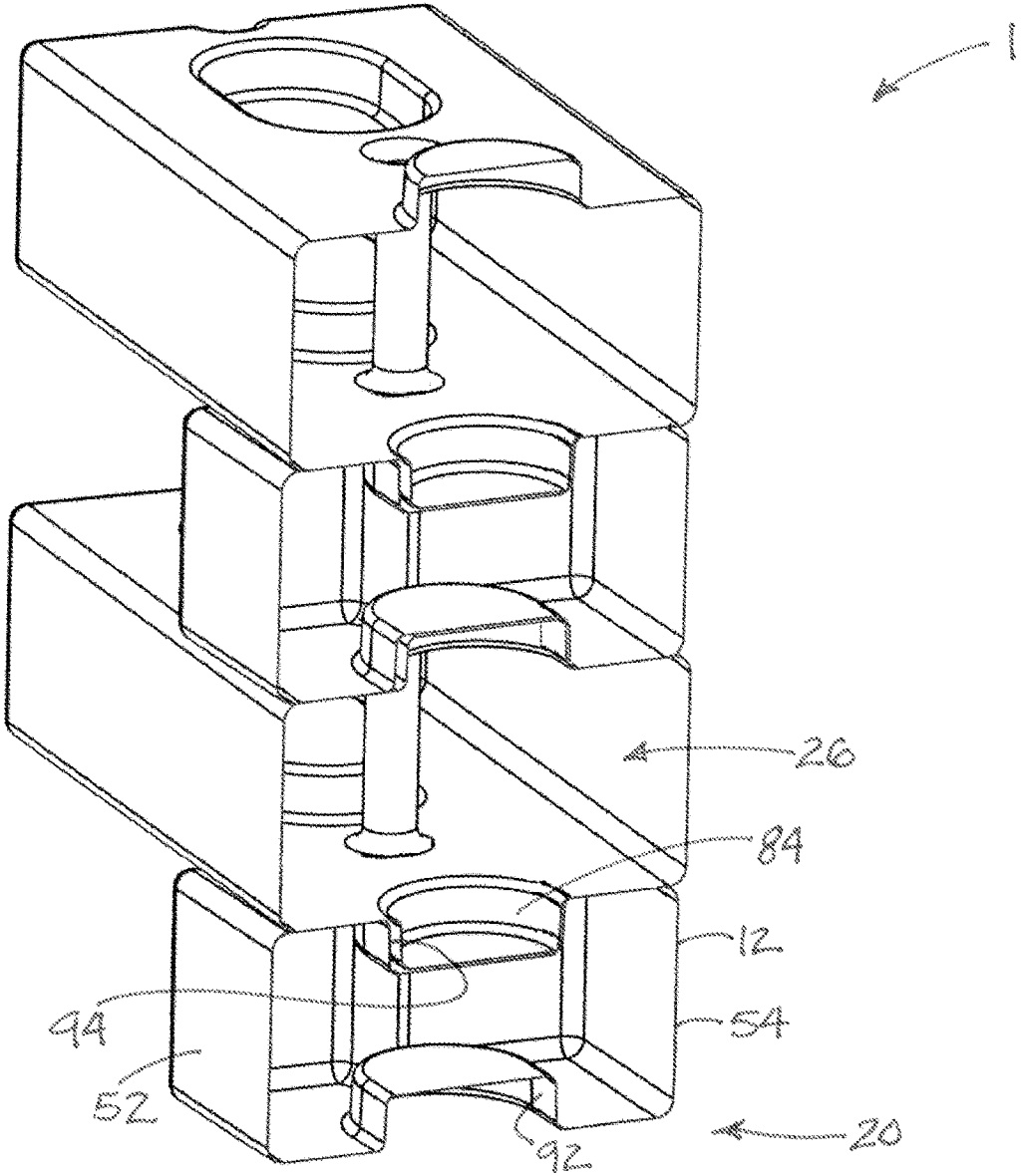
FIG. 6 is a schematic perspective sectional view of the stack of the containers having the illustrative configuration shown in FIG. 1, taken along line 6-6 in FIG. 1, according to an illustrative embodiment.
Figure 7:
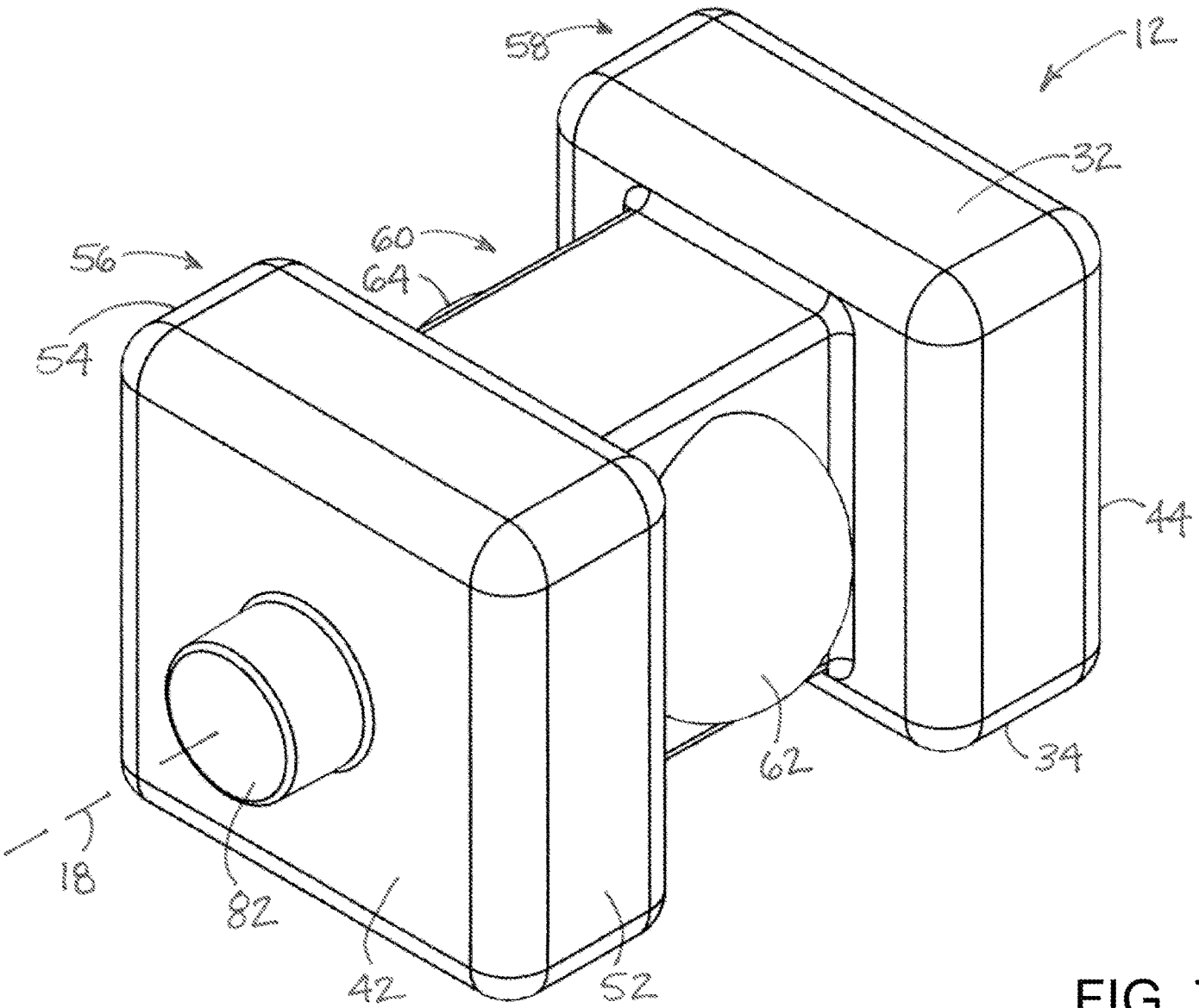
FIG. 7 is a schematic perspective view of a further illustrative embodiment of a container of the new multipurpose reusable container system, according to the present disclosure.
Figure 8:
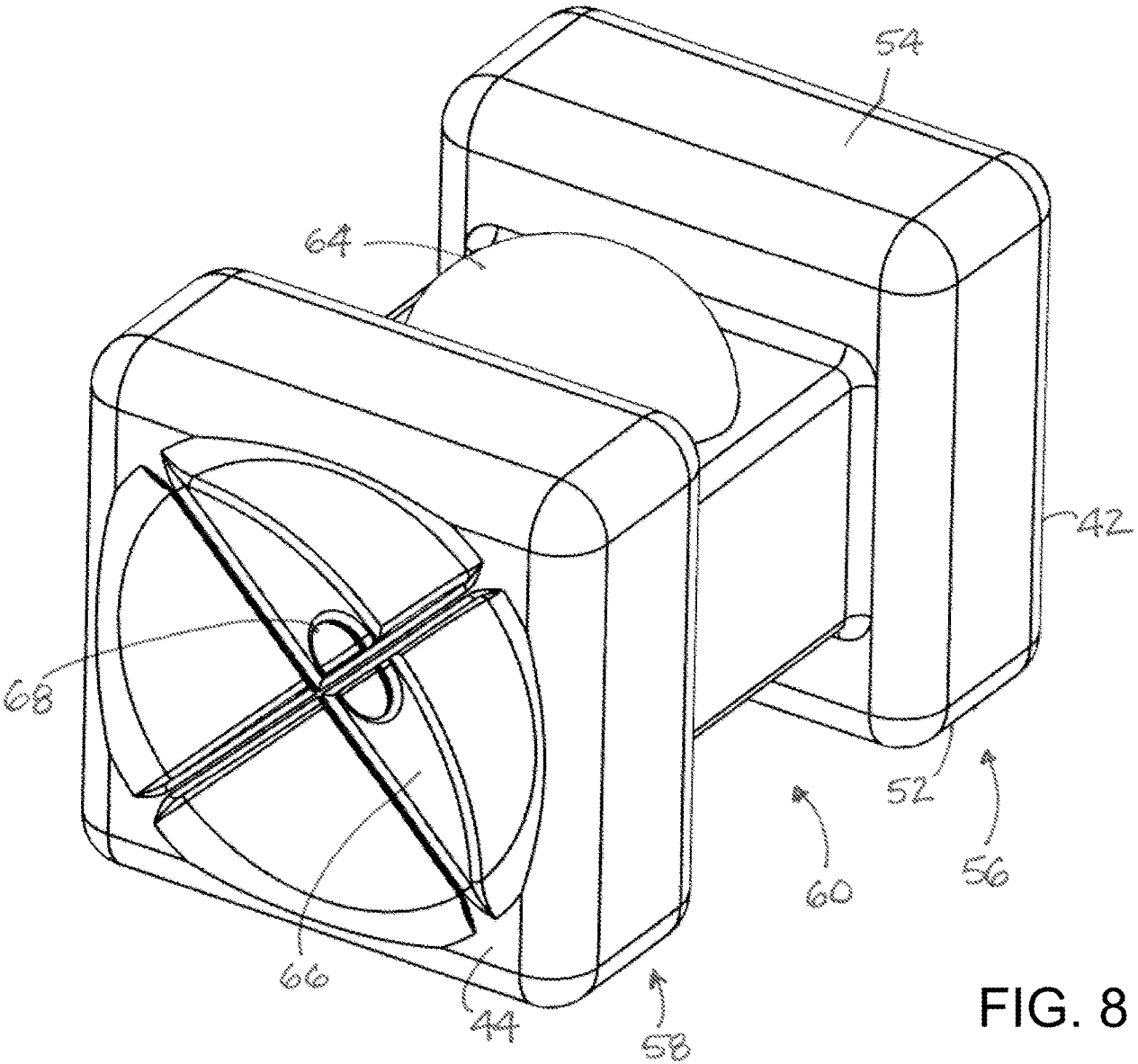
FIG. 8 is a schematic alternate perspective view of the illustrative embodiment of the container shown in FIG. 7, according to the present disclosure.
Figure 9:
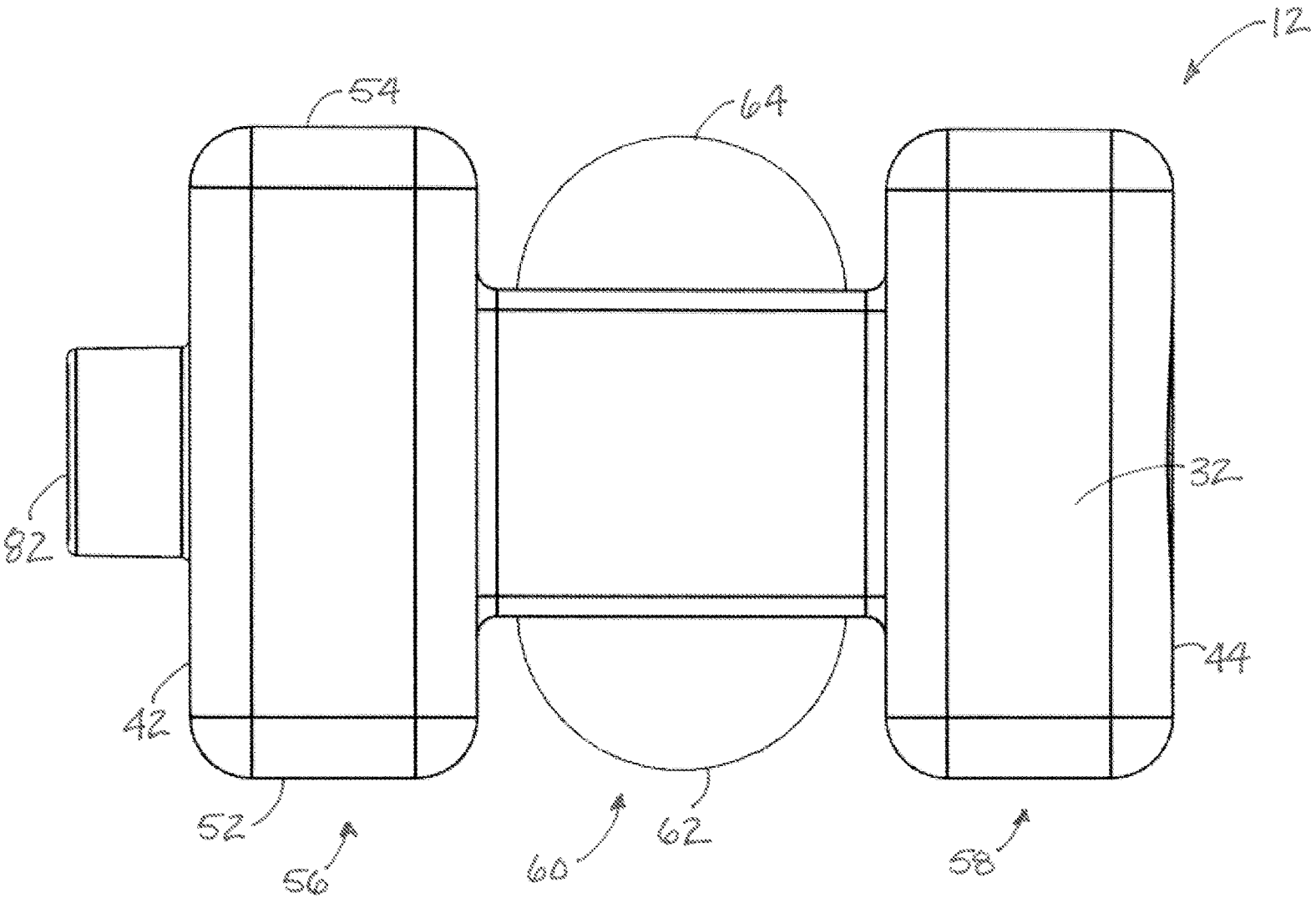
FIG. 9 is a schematic side view of the illustrative embodiment of the container shown in FIG. 7, according to the present disclosure.
Figure 10:
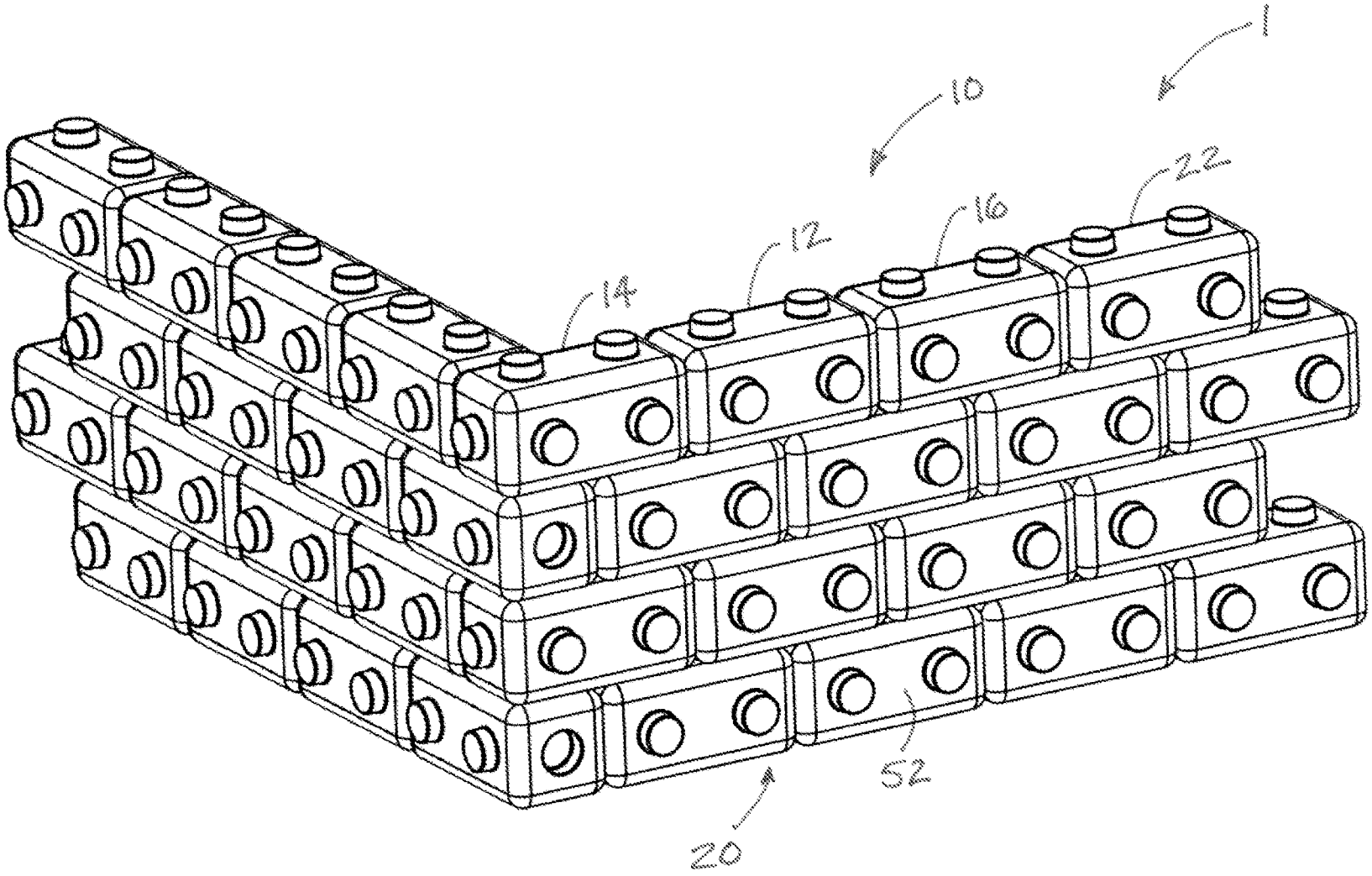
FIG. 10 is a schematic perspective view of the new multipurpose reusable container system showing another illustrative embodiment of the container in a stack of containers, according to the present disclosure.
Figure 11:
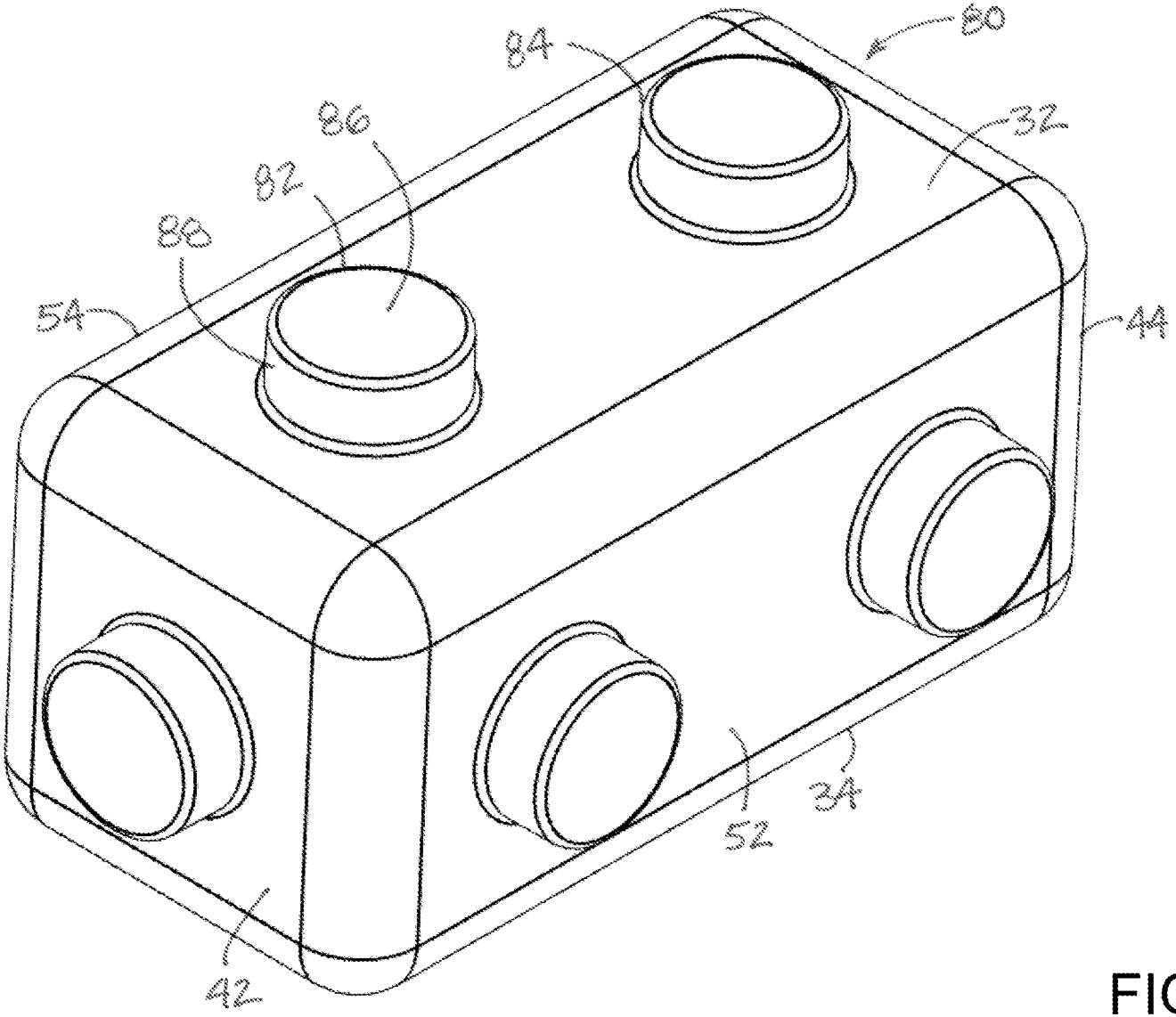
FIG. 11 is a schematic perspective view of the container of the illustrative embodiment shown in FIG. 10, according to the present disclosure.
Figure 12:
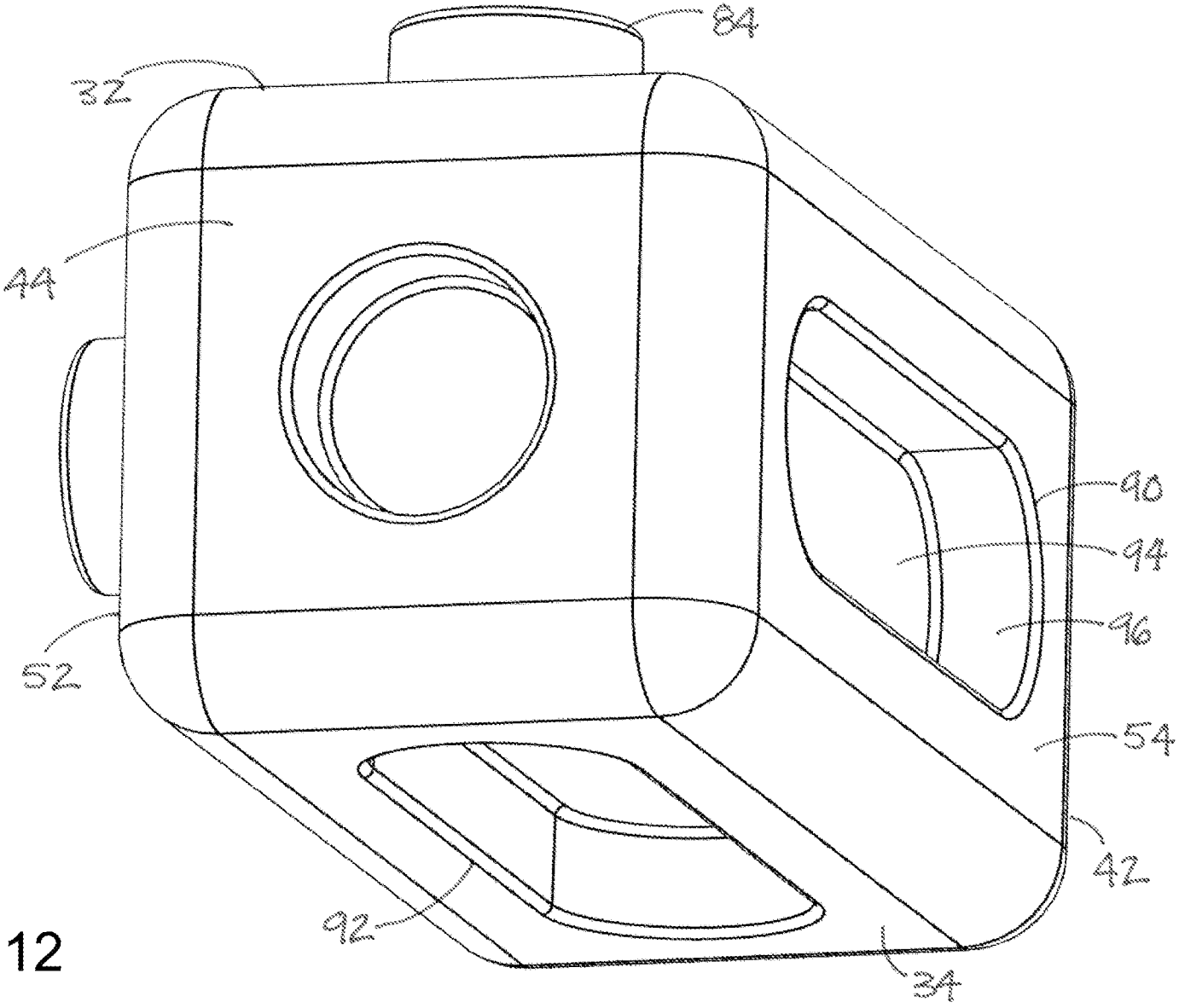
FIG. 12 is a schematic alternate perspective view of the container of the illustrative embodiment shown in FIG. 10, according to the present disclosure.
Figure 13:
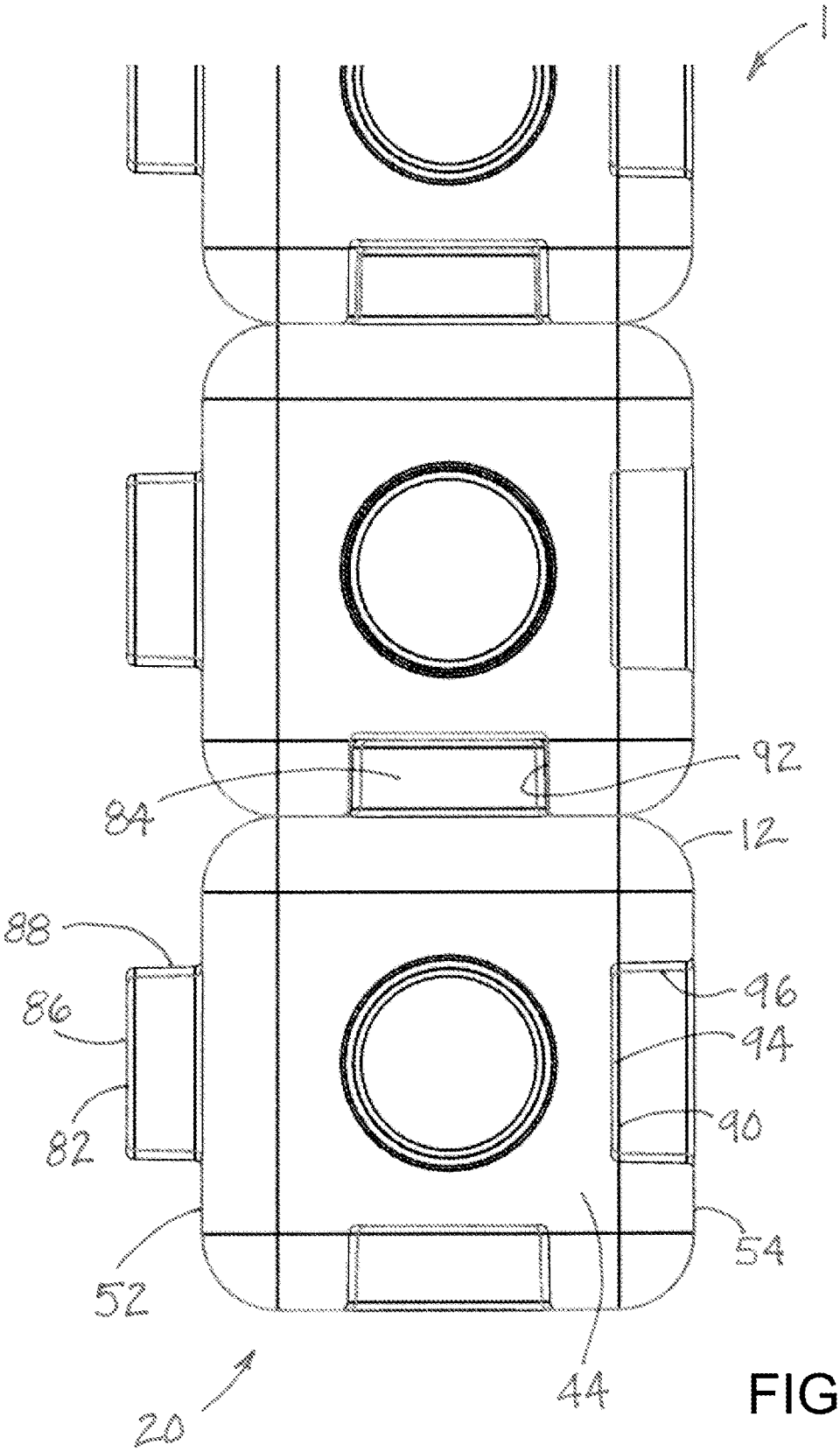
FIG. 13 is a schematic sectional view of a stack of the containers of the illustrative embodiment shown in FIG. 10, according to the present disclosure.
Figure 14:
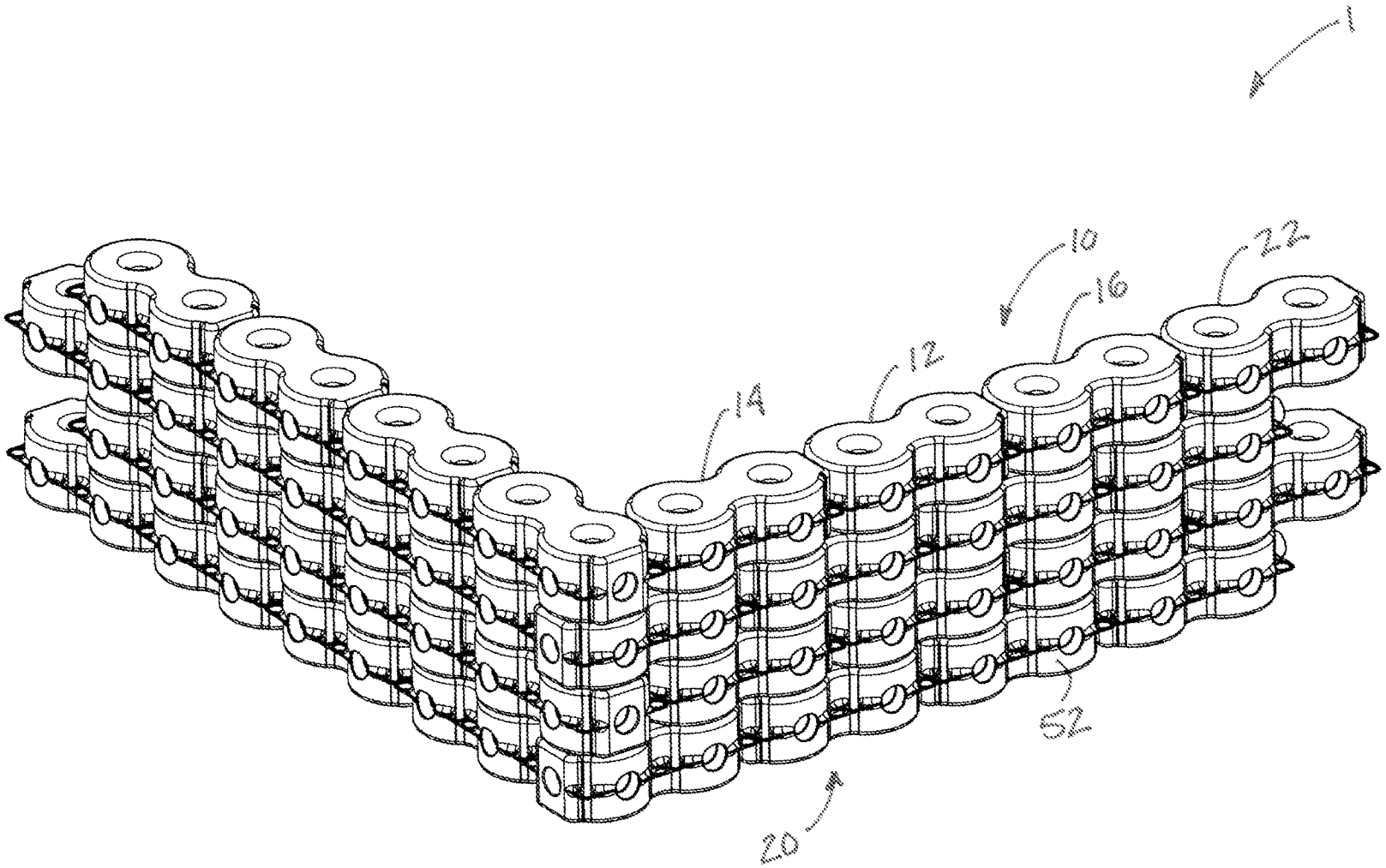
FIG. 14 is a schematic perspective view of the new multipurpose reusable container system showing still another illustrative embodiment of the container in a stack of containers, according to the present disclosure.
Figure 15:
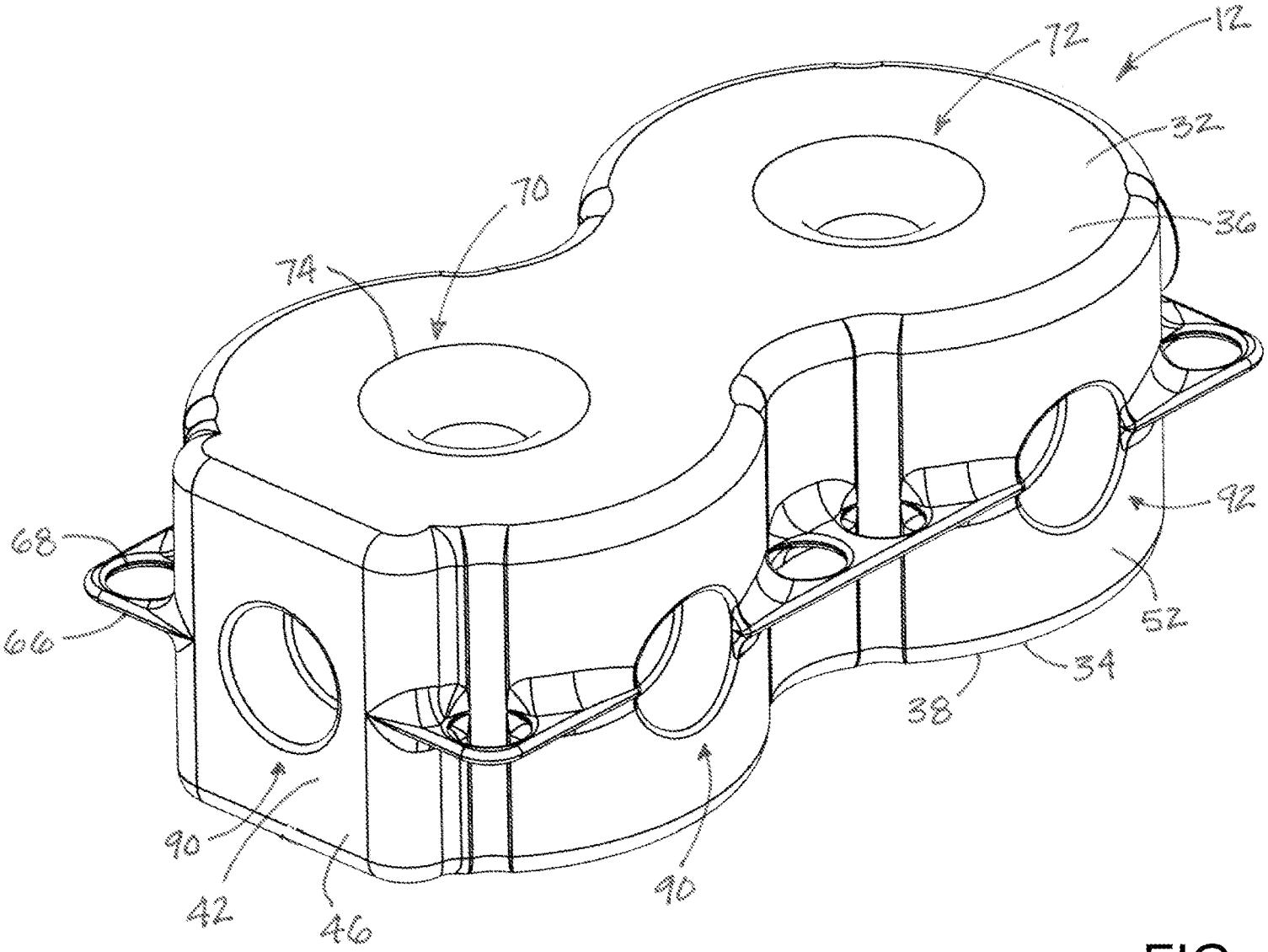
FIG. 15 is a schematic perspective view of the container of the illustrative embodiment shown in FIG. 14, according to the present disclosure.
Figure 16:
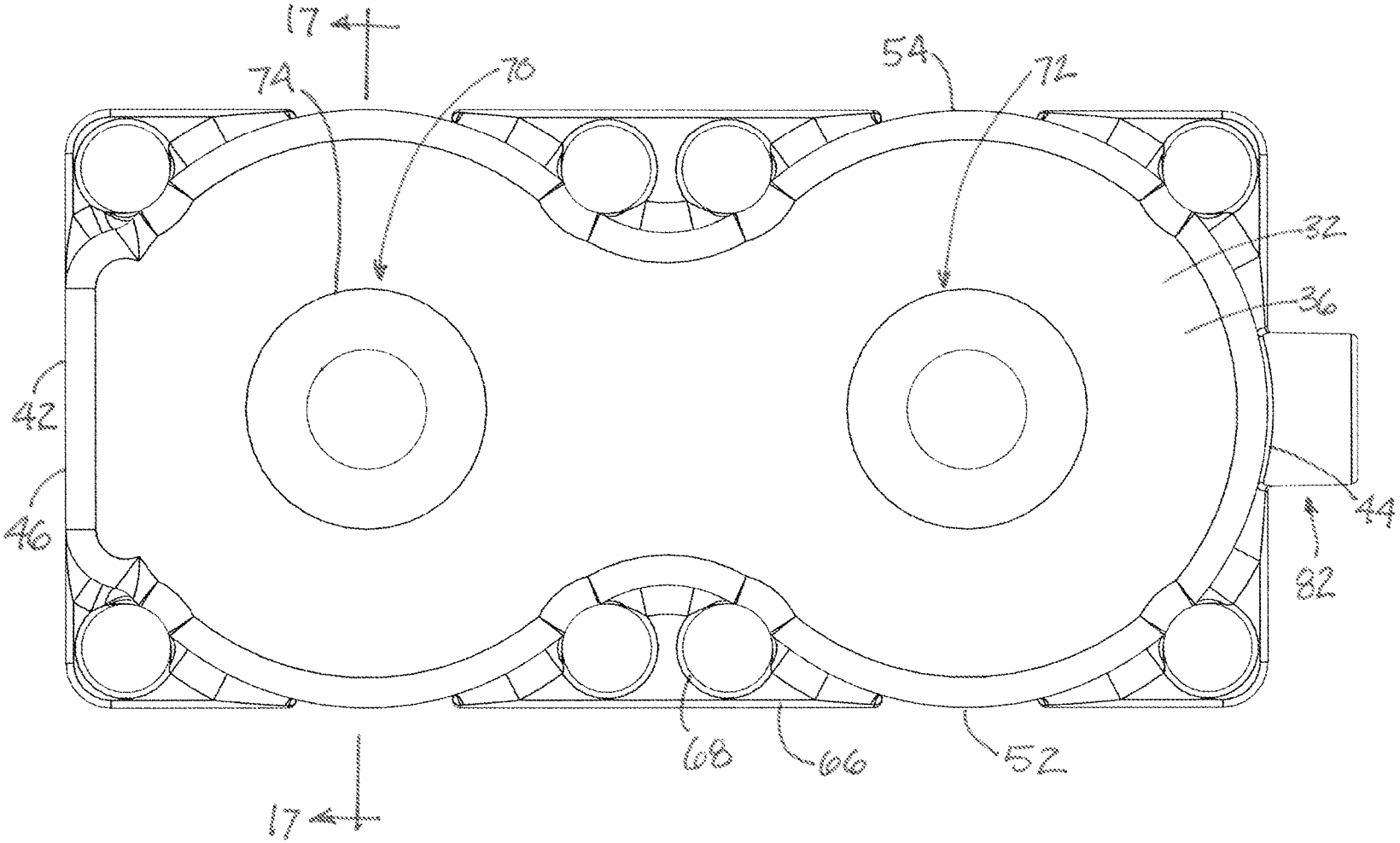
FIG. 16 is a schematic top view of the container of the illustrative embodiment shown in FIG. 14, according to the present disclosure.
Figure 17:
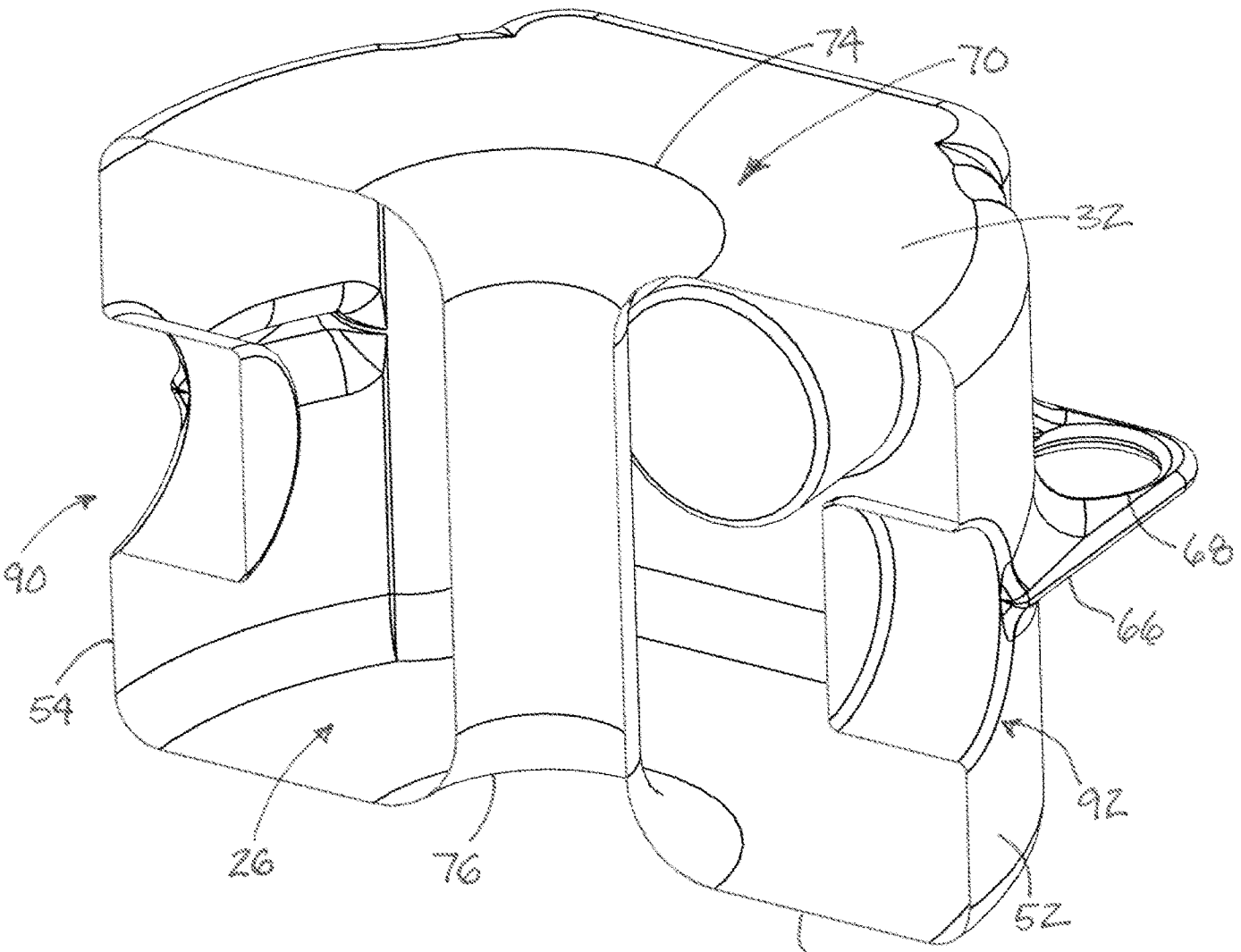
FIG. 17 is a schematic sectional view of the container of the illustrative embodiment shown in FIG. 14, taken along line 17-17 of FIG. 16, according to the present disclosure.
Figure 18:
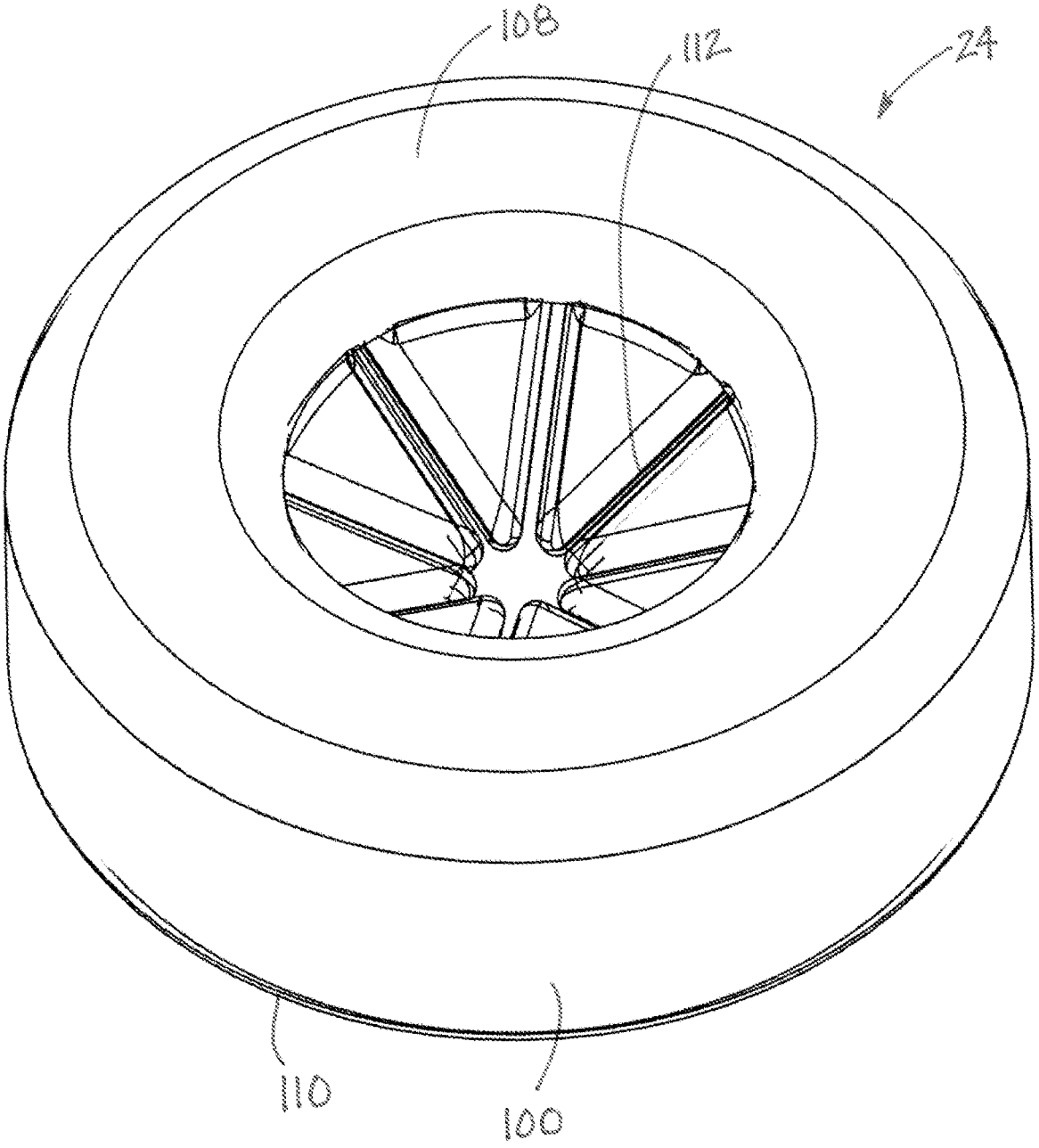
FIG. 18 is a schematic perspective view of an embodiment of a cap portion of the new multipurpose reusable container system, according to the present disclosure.
Figure 19:
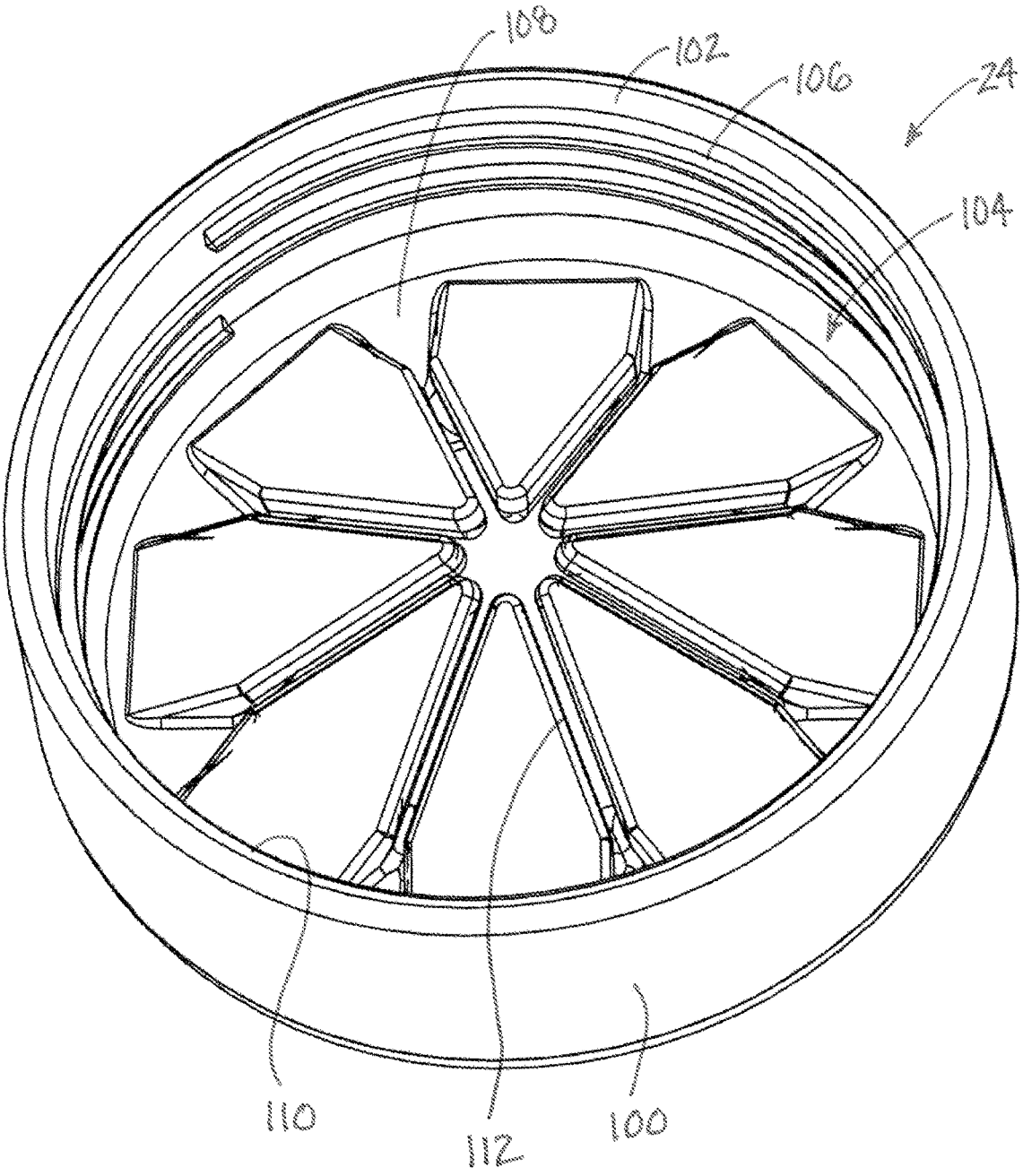
FIG. 19 is a schematic perspective view of an embodiment of the cap portion shown in FIG. 18, according to the present disclosure.

With reference now to the drawings, and in particular to FIGS. 1 through 19 thereof, a new multipurpose reusable container system embodying the principles and concepts of the disclosed subject matter will be described.

The applicants have recognized that large qualities of bottled liquids, such as water, are shipped to the locations of disasters or devastation where local municipal services are impaired or destroyed or otherwise nonexistent, to provide clean water to persons affected by the situation. While the provision of water is extremely helpful and necessary for the affected persons to recover, the implements utilized to transport the liquids—plastic bottles or containers—can become burdensome to dispose of when conventional litter disposal is often not available, if ever available.

The applicants have thus conceived of a system in which containers used for transporting liquids to a location of need can have beneficial uses after the containers have been emptied of their contents, and in particular uses that may assist in building or rebuilding shelters, which can be especially valuable as a part of a disaster recovery operation, so that the containers do not simply become trash that needs disposal and litter if not properly disposed.

The disclosure generally relates to a system 10 useful for conveying or transporting a substance, such as liquid, and which is also useful for forming a structural element of a larger structure, such as a wall 1. In one aspect, the system 10 of the disclosure may include at least one multipurpose reusable container 12 which may be individually employable to hold a liquid or other substance during storage, transport, and dispensing of the substance. In another or additional aspect, the system 10 of the disclosure may include a plurality of multipurpose reusable containers 12, 14, 16 which may also be individually employable to hold a liquid or other substance, but the containers may also be collectively employed as structural elements to form a structure, or a portion of a structure, for a purpose different from the purpose of holding a substance.

As such, the one or more containers may have an initial usage or purpose and may have a subsequent usage or purpose, and the range of usages of the plurality containers is expanded beyond the usages of a single container by itself. Moreover, some usages of the container or containers may require portability, and some usages may require the container containers to be stationary. In some of the most preferred implementations of the system 10, the secondary, subsequent use or purpose of the containers may not require any, or any significant, modification of the container, or require disposal of some portions of the container while retaining other portions for the secondary use. Broadly, the containers may have features which permit two or more containers to be connected directly to each other without requiring other parts or fasteners, and to be connected in a manner that aligns the containers to permit stacking of the containers in vertical and horizontal directions, making the useful for structural purposes, such as in forming a wall or a barrier for temporary shelter. In the subsequent or secondary usage, the container 12 may be filled with other flowable substance, such as sand or soil, which may provide additional heft as well as strength to the container in a structural application.

For the purposes of this description, a single container 12 will be described with the understanding that additional containers 14, 16 may have identical, or substantially identical, configurations, as well as configurations that may vary to some degree from the configuration of container 12.

In the illustrative embodiments, the container 12 may be elongated in a longitudinal direction along a longitudinal axis 18, although, in light of the present disclosure, other configurations without elongation may become apparent. An elongated container 12 may have a length dimension measured in a direction substantially parallel to the longitudinal axis 18, and may have a width dimension measured in a direction oriented substantially perpendicular to the longitudinal axis. In some embodiments, the length dimension may be approximately 150 percent to 250 percent of the width dimension, although length dimensions up to 300 percent to 400 percent or more are also contemplated in this disclosure.

In general, the multipurpose container 12 may be configured in a manner that permits a stacking arrangement of a plurality of containers in a stack 20 of containers to form, for example, the wall 1. The stack 20 of containers may be substantially vertically oriented, and in some embodiments, the containers in the stack of containers being positioned in a lapped manner to form a running bond arrangement to facilitate locking together the containers of the stack 20.

In greater detail, the container 12 may include a bottle portion 22 and a cap portion 24 which may be removably mounted on the bottle portion to close off contents held within the bottle portion. The bottle portion 22 may define an interior 26 for receiving flowable substances such as, for example, liquids, gels, pastes, or even granular materials. The bottle portion 22 may have an opening which is in communication with the interior 26 and permits the introduction of the substances into the interior 26 as well as emptying of the interior of the substances. The bottle portion 22 may have a single opening without any other opening into the interior 26. The bottle portion 22 may be formed of a single piece of material, and may be formed using any suitable formation technology which provides a degree of rigidity permitting the bottle portion 22 to retain its shape when the interior is empty or full, but may permit crushing of the bottle portion if sufficient force is applied to the container. The bottle portion 22 may be formed using, for example, suitable plastic molding techniques, such as blow molding.

The bottle portion 22 may include a bottle wall 30 which may extend about the interior 26 to enclose the interior, with the exception of the opening. A portion of the bottle wall 30 may form a neck about the opening, and threads may be formed on the neck for removably securing the cap portion onto the bottle portion. The bottle wall 30 has an outer surface which may form a plurality of faces for the container 12.

In some embodiments, the outer surface of the bottle wall 30 has primary faces 32, 34 which may be configured to facilitate vertical stacking of one container on another container in a vertical direction in the stack 20 of containers. The primary faces 32, 34 may be positioned on the outer surface of the bottle wall 30 at substantially opposite locations on the bottle wall with respect to each other. The primary faces may include a first primary face 32 and a second primary face 34, and the first 32 and second 34 primary faces may be laterally spaced with respect to each other on either side of a central longitudinal axis of the container. Illustratively, the first primary face 32 may form a top face for orienting upwardly in the stack 20 of containers such that another container may be rested upon the first primary face. The second primary face 34 may form a bottom face for orienting downwardly in the stack 20 of containers such that the second primary face may rest upon another container or a surface. The primary faces 32, 34 may each have a respective support region 36, 38 which may form at least a portion of the interface between containers in the stack 20. The support regions 36, 38 of the respective primary faces may be substantially flat in shape, and may be oriented substantially parallel to each other to facilitate stacking of the containers in a stable manner. The primary faces may have regions other than the support regions that may not directly provide support or an interface between adjacent containers in the stack 20.

The outer surface of the bottle wall 30 may also have secondary faces 42, 44 which are configured to permit stacking of the containers adjacent to each other in a horizontal direction or array. The secondary faces 42, 44 may be positioned on the outer surface of the bottle wall 30 at substantially opposite locations on the bottle wall with respect to each other. The secondary faces may include a first secondary face 42 and a second secondary face 44, and the first 42 and second 44 secondary faces may be longitudinally spaced with respect to each other along the longitudinal axis 18. The first secondary face 42 may be a first end face for orienting in one horizontal direction in the stack 20 of containers and the second secondary face 44 may be a second end face for orienting in another, opposite horizontal direction. In some embodiments, the secondary faces may each extend between the primary faces. At least one of the secondary faces 42, 44 may have an abutment region, and illustratively each of the secondary faces may have an abutment region 46, 48 which may form at least a portion of an interface between containers at the same horizontal level in the stack 20. The abutment regions 46, 48 of the secondary faces may be substantially flat in shape to facilitate horizontal abutment of the containers.

In some embodiments, such as illustratively shown in FIGS. 7 through 11, the abutment regions 46, 48 of the secondary faces may be oriented substantially parallel to each other, and the abutment regions 46, 48 may also be oriented substantially perpendicular to the support regions 36, 38 of the primary faces. In other embodiments, such as illustratively shown in FIGS. 1 through 4, the abutment regions 46, 48 of the secondary faces may not be parallel, and may be oriented at oblique angles with respect to the primary faces. In such configurations, the abutment regions 46, 48 may be oriented at a slight angle with respect to a plane perpendicular to an adjacent primary face (see, e.g., FIGS. 2 and 4), such that planes defined by the abutment regions tend to converge toward one lateral side of the bottle wall in tend to diverge toward the opposite lateral side of the bottle wall, a relationship which may permit containers in the stack 20 to be positioned adjacent to each other end to end in a curved alignment in a horizontal plane.

The secondary faces 42, 44 may have regions other than the abutment regions that may not directly abut against adjacent containers in the stack 20. For example, in some embodiments, such as illustratively shown in FIGS. 1 through 4, at least one secondary face 44 may have the abutment region 48 and also an inset region 50 which may be inset with respect to the abutment region 48 in a direction toward the center of the bottle portion 22. Optionally, the opening of the bottle portion may be located on the inset region 50, and the inset region may be configured such that the cap portion 24, when mounted on the neck of the bottle portion positioned about the opening, does not extend through a plane defined by the abutment region 48 and does not interfere with the positioning of secondary faces of adjacent containers close to or in abutment with each other.

The outer surface of the bottle wall 30 may further have opposite side faces 52, 54 which may extend between the primary faces and may also extend between the secondary faces. The side faces 52, 54 may be oriented substantially perpendicular to the primary faces, and may be oriented substantially perpendicular to the secondary faces while in some embodiments the side faces may be oriented at oblique angles with respect to the abutment regions of the secondary faces. The side faces 52, 54 of containers in a stack 20 of containers may be laterally spaced from a central longitudinal axis of the container and may effectively form the front and rear surfaces of a wall 1 produced by the stack 20 of containers.

While in some embodiments of the multipurpose container 12 the lateral cross-sectional shape of the bottle portion 22 may be substantially uniform in the longitudinal direction and the width dimension of the container may also be substantially uniform (see, e.g., FIGS. 1 through 6), in other embodiments the width dimension of the container may vary in the longitudinal direction. Illustratively, such as shown in the embodiments depicted in FIGS. 7 through 9, the width dimension of the container 12 may be relatively larger toward the secondary faces 42, 44 of the bottle wall and relatively smaller at a location between the secondary faces of the bottle wall. Such characteristics may facilitate, for example, gripping of the container 12 during handling of the container by hand, and may also provide a space exterior to the container which produces a cavity in a stack 20 of containers in which fill material may be positioned.

In the illustrative embodiment, the bottle wall 30 may have a pair of end sections 56, 58 spaced from each other in the longitudinal direction of the container 12. A cross-section of the end sections taken in a plane oriented substantially perpendicular to the longitudinal axis may have a substantially rectangular shape, and in some embodiments may have a substantially square shape, form by the primary and side faces of the bottle wall 30. The bottle wall 30 may also have a central section 60 which is positioned between the end sections 56, 58 and which may have a width dimension that is less than a width dimension of the end sections.

A cross-section of the central section 60 taken in a plane oriented substantially perpendicular to the longitudinal axis 18 may have a substantially rectangular shape. In some embodiments, at least one bulbous protrusion 62 may be formed on the central section 60 which extends laterally outwardly with respect to the longitudinal axis 18, and in embodiments a pair of bulbous protrusions 62, 64 may be formed on the central section and may extend outwardly in substantially opposite directions with respect to each other. Optionally, the protrusion or protrusions 62 may be constructed to selectively protrude from the side face to increase the volume of the interior 26 and thereby increase the water carrying capacity of the container, or intrude into the side face to decrease the volume of the interior 26 and increase the exterior space available to accept fill between the end sections 56, 58.

In some embodiments of the multipurpose container 12, such as those illustratively shown in FIGS. 8 and 14 through 17, the bottle portion 22 may include a flange structure 66 that extends outwardly from one or more of the faces of the bottle wall 30, and may extend from the bottle wall continuously, or substantially continuously, about the bottle portion. The flange structure 66 may form a relatively thin protrusion from the face or faces of the bottle wall, and may extend in a plane oriented parallel to the longitudinal axis 18 of the container. The flange structure 66 may have at least one securing aperture 68 extending through the flange structure, and may have a plurality of securing apertures in the flange structure distributed along the plan structure, which may be useful for securing or attaching things to the container, such as ropes or cords, which in turn may be utilized to attach an object or objects to the containers, or even attach the containers together.

In some embodiments, such as those illustratively shown in FIGS. 1 through 6 and 14 through 17, the bottle portion 22 may define at least one channel 70 that may extend through the container 12 and may create a pathway for passing through the container an object, such as an elongate element (e.g., a rope or pole or rod or rebar) to connect containers together or facilitate anchoring of the containers. The bottle wall 30 may form the channel 70 which may extend between openings 74, 76 located on opposite locations of the container 12, such as in opposite faces of the bottle wall. The channel 70 may extend along an axis oriented substantially perpendicular to the longitudinal axis 18 of the container, and illustratively may extend from the first primary face 32 to the second primary face 34. In some further embodiments, a pair of the channels 70, 72 may extend through the container 12, and the axes of the channels may be oriented substantially parallel to each other. In addition to providing additional engagement or connection points, the sections of the wall portion utilized to form the channels may further strengthen or reinforce the faces from which the channels extend against collapse of the container when pressure is applied to the outer surface of the container.

Another significant aspect of the multipurpose container 12 may be the provision of alignment features 80 which are configured to facilitate alignment of the bottle portions when two or more multipurpose containers 12, 14, 16 are arranged in the stack 20 of containers, and the alignment features may also be configured to form a connection between the two or more containers. The alignment features 80 may be complementary in configuration to permit engagement between alignment features on individual containers to produce alignment and/or connection of the containers. In embodiments, at least one of the alignment features 80 may be located on each of the primary faces 32, 34, and in some embodiments at least a pair of the alignment features may be located on each of the primary faces. Illustratively, the pair of alignment features may be aligned in a direction parallel to the longitudinal axis 18. Further, the alignment features on the containers may be positioned and arranged such that the alignment features of adjacent containers in the stack 20 of containers are able to engage each other when the containers are positioned in a running bond arrangement in the stack 20. Optionally, the alignment features on the containers may also be positioned and arranged such that the containers in the stack 20 may engage each other when the secondary faces of the containers are in a vertical alignment In further embodiments, at least one of the alignment features may be located on each of the secondary faces 42, 44. In some embodiments of containers having the alignment features, some of the faces may be free of any of the alignment features, such as the side faces 52, 54 (see. e.g., FIGS. 1 through 6), although in further embodiments, the side faces may have at least one alignment feature (e.g., FIGS. 10 through 13 and FIGS. 14 through 17).

In some embodiments, the alignment features 80 may include at least one aligning lug 82 formed on the bottle portion 22 of the container 12. The aligning lug 82 may be positioned on one or more of the primary faces 32, 34, and may be positioned on one or more of the secondary faces 42, 44, and may be positioned on one or more of the side faces 52, 54. Optionally, a plurality of the aligning lugs 82, 84 may be formed on the bottle portion 22. Each aligning lug 82, 84 may protrude from one of the faces of the bottle wall 30. Each lug 82 may be characterized by having a terminal surface 86 which may be substantially flat in character and may lie in a plane oriented substantially parallel to the face in which the lug is located, such as, for example, one of the primary faces. Each aligning lug may be further characterized by having a transitional surface 88 which may extend between the terminal surface 86 and the face in which the lug is located, and may extend from the surface 86 to the face. In the illustrative embodiments, the transitional surface 86 may be substantially cylindrical in shape and the terminal surface 88 may be substantially circular in shape, although, in light of the present disclosure, those skilled in the art may recognize other configurations and shapes that are also suitable.

The plurality of aligning lugs may include a first aligning lug 82 and a second aligning lug 84. In embodiments, the first aligning lug 82 may be located on the first primary face 32, and the second aligning lug 84 may also be located on one of the primary faces. The second aligning lug 84 may be located on the (same) first primary face 32 (see, e.g., FIGS. 10 through 13), or may be located on the second primary face 34 (see, e.g., FIGS. 1 through 6).

In some embodiments, the alignment features 80 may include at least one aligning recess 90 formed on the bottle portion 22 of the container 12. The aligning recess 90 may be may be configured to receive at least one of the aligning lugs 82, and may be configured to receive a pair of the aligning lugs when the lugs are positioned on the same face of the bottle wall. The aligning recess 90 may be positioned on one or more of the primary faces 32, 34, and may be positioned on one or more of the secondary faces 42, 44, and may be positioned on one or more of the side faces 52, 54. Optionally, a plurality of the aligning recesses 90, 92 may be formed on the bottle portion 22. Each aligning recess may be depressed into one of the faces of the bottle wall 30. Each aligning recess 90, 92 may be characterized by having a base surface 94 which may be substantially flat and may lie in a plane oriented substantially parallel to the face in which the recess is located, such as, for example, in one of the primary faces. Each aligning recess 90, 92 may be further characterized by having an intervening surface 96 which may extend between the base surface 94 and the face in which the recess is located, and may extend from the surface 96 to the face. In some embodiments, the openings 74, 76 of one or more channels 70, 72 may function as aligning recesses without having base surfaces.

In some of the illustrative embodiments, such as is shown in FIGS. 12 through 17, the base surface 94 may be circular in shape and the intervening surface is substantially cylindrical in shape. In further illustrative embodiments, such as is shown in FIGS. 3 through 6 and 12, the aligning recess may be elongated, for example, in a direction parallel to the longitudinal axis 18 of the container so that the recess is able to receive more than one of the lugs at the same time or to provide some flexibility in the alignment needed between the lugs and recesses for a suitable mating relationship. In such embodiments, the base surface 94 of the aligning recess may be obround in shape and the intervening surface being semi-cylindrical at the ends and substantially planar between the ends. Those skilled in the art, in light of the present disclosure, may recognize other configurations and shapes that are also suitable.

The plurality of aligning recesses may include a first aligning recess 90 and a second aligning recess 92. In some embodiments, the first aligning recess 90 may be located on the first primary face 32 and the second aligning recess 92 may also be located on one of the primary faces, such as on the (same) first primary face 32 (see, e.g., FIGS. 14 through 17) or may be located on the second primary face 34 (see, e.g., FIGS. 1 through 6).

In some embodiments, at least one aligning lug 82 and at least one aligning recess 90 may be located on a primary face (see, e.g., FIGS. 1 through 6). In some embodiments, a pair of the aligning lugs 82, 84 may be located on a primary face (see, e.g., FIGS. 11 through 13) and/or on a side face (see, e.g., FIGS. 11 through 13). In some embodiments, a pair of the aligning recesses 90, 92 may be located on a primary face (see, e.g., FIGS. 14 through 17) and/or on a side face (see, e.g., FIGS. 14 through 17).

Turning to the cap portion 24 of the container 12, portion 24 may be positionable on or over the opening located on the bottle wall 22 in order to selectively close the opening to retain the contents in the interior 26 of the container, and open the opening to dispense the contents in the interior from the container or receive original contents for the container or subsequent contents. The cap portion may have an outer surface 100 and an inner surface 102, with the inner surface being generally oriented toward the opening when the cap portion is mounted on the bottle portion 22. The inner surface 102 of the cap portion may define a cavity 104, and at least a portion of the inner surface may have threads 106 formed thereon. The threads 106 on the cap portion may engage threads on the portion of the bottle wall 30 that forms the neck about the opening to permit the cap portion to be selectively mounted on the bottle portion. The cap portion 24 may have a closure wall 108 and a perimeter wall 110 extending from the closure wall. The closure wall 108 may be substantially circular in shape and the perimeter wall 110 may be substantially cylindrical in shape.

In some embodiments, the outer surface 102 of the cap portion may be configured similar to the surface of one of the aligning lugs 82 when the cap portion is mounted on the bottle wall 30 of the bottle portion, and may thus function as one of the lugs when 30 positioned on one of the faces of the bottle wall 30 such that the cap portion 24 may engage one of the aligning recesses of another container. This configuration can permit the cap portion 24 not to appreciably interfere with the stacking and abutment of the containers 12 in the stack 20.

In some embodiments, the cap portion 24 may have a breakthrough feature which permits an object to be passed through the cap portion upon some degree of fracture of the closure wall 108 of the cap portion. Illustratively, the cap portion may have a plurality of weakened material lines 112 which are formed in the closure wall and which extend radially outwardly from a center of the closure wall. The closure wall 108 may thus be fracturable along the plurality of weakened material lines such that the application of force to the closure wall of the cap portion using finger pressure can separate the material forming the closure wall 108 along the weakened material lines 112 to form flaps of the material between the fractured lines 112 and, for example, permit the passage of a rope or cord through the cap portion in one direction through the cap portion, while resisting movement of the rope or cord in the opposite direction through the cap portion, to produce a binding element.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system comprising a multipurpose container configured to contain a flowable substance and form a structural element when multiple multipurpose containers are positioned in a stack of the multipurpose containers, the container being elongated in a longitudinal direction such that a longitudinal dimension of the container is greater in magnitude than a width dimension of the container in a direction substantially parallel to the longitudinal direction, the container comprising a bottle portion and a cap portion, the bottle portion defining an interior for receiving the flowable substance into the interior and dispensing the flowable substance from the interior, the bottle portion including a bottle wall extending about the interior and forming an outer surface, the outer surface having:

primary faces being oriented substantially opposite of each other on the bottle portion and being configured to permit vertical stacking of a first said container on a second said container in a vertical direction in the stack formed of said containers, the primary faces including a first primary face and a second primary face;

secondary faces being oriented substantially opposite with respect to each other on the bottle portion and being configured to permit horizontal adjacency of the first container with the second container in a horizontal direction in the stack of containers, the secondary faces including a first secondary face and a second secondary face; and alignment features configured to facilitate alignment of the bottle portions when two or more containers are arranged in the stack of containers, at least a pair of the alignment features being located on the primary faces, the alignment features including:

at least one aligning lug located on and protruding from the first primary face of the first container, the at least one aligning lug having a substantially cylindrical transitional surface extending from the first primary face; and at least one aligning recess located on the second primary face of the first container, the at least one aligning recess being depressed into the second primary face of the first container to removably receive at least one aligning lug of the second container in the stack of containers;

wherein the at least one aligning recess is elongated in the longitudinal direction of the first container; and wherein the at least one aligning recess has longitudinally opposite closed ends to block sliding longitudinal movement of the at least one aligning lug of the second container out of the elongated aligning recess of the first container.

2. The system of claim 1 wherein at least one aligning lug and at least one aligning recess are located on a same face of the first and second primary faces of the outer surface of the bottle wall.

3. The system of claim 1 wherein the at least one aligning lug comprises a pair of aligning lugs located on the first primary face of the outer surface of the bottle wall.

4. The system of claim 3 wherein the at least one aligning recess comprises a pair of aligning recesses located on the second primary face of the outer surface of the bottle wall.

5. The system of claim 1 wherein the alignment features are additionally located on the secondary faces of the outer surface of the bottle wall.

6. The system of claim 5 wherein the alignment features additionally include:

at least one aligning lug located on and protruding from the first secondary face; and at least one aligning recess located on and depressed into the second secondary face to removably receive the at least one aligning lug of a said container in the stack of containers.

7. The system of claim 1 wherein the outer surface of the bottle wall additionally comprises side faces being oriented substantially opposite of each other on the bottle portion and extending between the primary faces.

8. The system of claim 7 wherein the alignment features additionally include:

at least one aligning lug located on and protruding from a first one of the side faces; and at least one aligning recess located on and depressed into a second one of the side faces to removably receive the at least one aligning lug.

9. The system of claim 1 wherein the elongated at least one aligning recess of the alignment features is configured to permit the aligning recess to simultaneously receive at least two aligning lugs of the second container in the stack of containers.

10. The system of claim 1 wherein the bottle wall of the bottle portion of the container has a width dimension measured in a plane perpendicular to the longitudinal axis between the primary faces, the bottle wall having a pair of longitudinally spaced end sections and a central section located between the end sections; and wherein the width dimension between the primary faces varies in the longitudinal direction such that the width dimension of the central section of the bottle wall is smaller than the width dimension of each of the end sections of the bottle wall.

11. The system of claim 1 wherein the bottle portion of the container includes a flange structure extending outwardly from at least one of the faces of the outer surface of the bottle wall; and at least one securing aperture extending through the flange structure.

12. The system of claim 1 wherein the bottle portion of the container defines at least one channel extending through the container between opposite side faces of the outer surface of the bottle wall.

13. The system of claim 1 wherein the at least one multipurpose container comprises a plurality of multipurpose containers each configured to contain a flowable substance and form a structural element positionable in a stack of the containers to form a wall.

14. The system of claim 13 wherein the alignment features of each of the plurality of containers are additionally located on the secondary faces of the outer surface of the bottle wall of each container.

15. The system of claim 14 wherein the alignment features of each of the plurality of containers additionally include:

at least one aligning lug located on and protruding from the first secondary face; and at least one aligning recess located on and depressed into the second secondary face to removably receive the at least one aligning lug of a said container in the stack of containers.

16. The system of claim 1 wherein the at least one aligning recess of the first container is defined by a base surface and an intervening surface extending between the base surface and the primary face in which the aligning recess is formed; and wherein portions of the intervening surface of the at least one aligning recess are each substantially planar and are substantially parallel to each other to permit positioning of the at least one aligning lug of the second container in the stack of containers at a plurality of positions between the closed ends of the aligning recess.

17. A system comprising:

at least one multipurpose container configured to contain a flowable substance and form a structural element, the container comprising a bottle portion and a cap portion, the bottle portion defining an interior for receiving the flowable substance into the interior and dispensing the flowable substance from the interior, the bottle portion including a bottle wall extending about the interior and forming an outer surface, the outer surface having:

primary faces being oriented substantially opposite of each other on the bottle portion and being configured to permit vertical stacking of the container on another said container in a vertical direction in a stack formed of said containers, the primary faces including a first primary face and a second primary face;

secondary faces being oriented substantially opposite with respect to each other on the bottle portion and being configured to permit horizontal adjacency of the container with another said container in a horizontal direction in the stack of containers, the secondary faces including a first secondary face and a second secondary face; and alignment features configured to facilitate alignment of the bottle portions when two or more containers are arranged in the stack of containers, at least a pair of the alignment features being located on the primary faces, the alignment features including:

at least one aligning lug located on and protruding from the first primary face; and at least one aligning recess located on and depressed into the second primary face to removably receive the at least one aligning lug of a said container in the stack of containers;

wherein the bottle wall of the bottle portion of the container has a width dimension measured in a plane perpendicular to the longitudinal axis between the primary faces, the bottle wall having a pair of longitudinally spaced end sections and a central section located between the end sections;

wherein the width dimension between the primary faces varies in the longitudinal direction such that the width dimension of the central section of the bottle wall is smaller than the width dimension of each of the end sections of the bottle wall; and wherein at least one bulbous protrusion is formed by the bottle wall at the central section of the bottle wall, the at least one bulbous protrusion being changeable between a protruding configuration and an intruding configuration to change a volume of the interior of the bottle portion.

18. A system comprising:

at least one multipurpose container configured to contain a flowable substance and form a structural element, the container comprising a bottle portion and a cap portion, the bottle portion defining an interior for receiving the flowable substance into the interior and dispensing the flowable substance from the interior, the bottle portion including a bottle wall extending about the interior and forming an outer surface, the outer surface having:

primary faces being oriented substantially opposite of each other on the bottle portion and being configured to permit vertical stacking of the container on another said container in a vertical direction in a stack formed of said containers, the primary faces including a first primary face and a second primary face;

secondary faces being oriented substantially opposite with respect to each other on the bottle portion and being configured to permit horizontal adjacency of the container with another said container in a horizontal direction in the stack of containers, the secondary faces including a first secondary face and a second secondary face; and alignment features configured to facilitate alignment of the bottle portions when two or more containers are arranged in the stack of containers, at least a pair of the alignment features being located on the primary faces, the alignment features including:

at least one aligning lug located on and protruding from the first primary face; and at least one aligning recess located on and depressed into the second primary face to removably receive the at least one aligning lug of a said container in the stack of containers;

wherein the cap portion of the container has a closure wall and a perimeter wall, the perimeter wall extending from the closure wall; and wherein the cap portion has a breakthrough feature including a plurality of weakened material lines formed in the closure wall and extending radially outwardly from a center of the closure wall, the closure wall being fracturable along the plurality of weakened material lines such that the application of force to the closure wall of the cap portion separates leaves of material formed between the lines.

* * * * *